US007114508B2

(12) United States Patent
Worm et al.

(10) Patent No.: US 7,114,508 B2
(45) **Date of Patent: *Oct. 3, 2006**

(54) CLEANING APPARATUS HAVING MULTIPLE WASH TANKS FOR CARBON DIOXIDE DRY CLEANING AND METHODS OF USING SAME

(75) Inventors: Steve Lee Worm, Raleigh, NC (US); James B. McClain, Raleigh, NC (US)

(73) Assignee: Micell Technologies, Raleigh, NC (US)

( * ) Notice: Subject to any disclaimer, the term of this patent is extended or adjusted under 35 U.S.C. 154(b) by 321 days.

This patent is subject to a terminal disclaimer.

(21) Appl. No.: 10/402,526

(22) Filed: Mar. 28, 2003

(65) Prior Publication Data

US 2003/0182731 A1 Oct. 2, 2003

Related U.S. Application Data

(60) Division of application No. 09/669,154, filed on Sep. 25, 2000, now Pat. No. 6,589,592, which is a continuation-in-part of application No. 09/405,619, filed on Sep. 24, 1999, now Pat. No. 6,314,601.

(51) Int. Cl.
*B08B 3/00* (2006.01)

(52) U.S. Cl. ..... 134/61; 8/137; 8/142

(58) Field of Classification Search ..... 8/142, 8/158; 68/18 R, 18 C; 510/466
See application file for complete search history.

(56) References Cited

U.S. PATENT DOCUMENTS

| | | | | |
|---|---|---|---|---|
| 2,074,508 | A | 3/1937 | Hetzer | |
| 4,012,194 | A | 3/1977 | Maffei | 8/142 |
| 4,219,333 | A | 8/1980 | Harris | 8/137 |
| 4,243,056 | A | 1/1981 | de la Burde et al. | 131/140 |
| 4,877,530 | A | 10/1989 | Moses | 210/511 |
| 4,923,720 | A | 5/1990 | Lee et al. | 427/422 |
| 4,936,922 | A | 6/1990 | Cherry | 134/22.18 |
| 5,013,366 | A | 5/1991 | Jackson et al. | 134/1 |
| 5,027,742 | A | 7/1991 | Lee et al. | 118/300 |
| 5,267,455 | A | 12/1993 | Dewees et al. | 68/5 |

(Continued)

FOREIGN PATENT DOCUMENTS

EP 0 527 699 A1 2/1993

(Continued)

OTHER PUBLICATIONS

International Search Report for Int'l Appl. No. PCT/US00/25786, dated Feb. 1, 2001.

(Continued)

*Primary Examiner*—Gregory Webb
(74) *Attorney, Agent, or Firm*—Myers Bigel Sibley & Sajovec, P.A.

(57) ABSTRACT

Cleaning apparatus having multiple wash tanks for washing articles in a carbon dioxide dry cleaning system employing a liquid carbon dioxide cleaning solution are provided. Cleaning apparatus having multiple wash tanks of the present invention may provide improved thermodynamic efficiency by allowing carbon dioxide vapor to be transferred between wash tanks rather than condensed. Cleaning apparatus having multiple wash tanks of the present invention may have a lower capital cost than multiple cleaning systems having single wash tanks. Cleaning apparatus having multiple wash tanks of the present invention include a first wash tank for contacting a first article with liquid carbon dioxide cleaning solution, and a second wash tank for contacting a second article with liquid carbon dioxide cleaning solution. The second wash tank is in fluid communication with the first wash tank. Methods of utilizing such cleaning apparatus are also provided. Coating apparatus having multiple coating tanks and methods of utilizing such coating apparatus are also provided.

28 Claims, 10 Drawing Sheets

U.S. PATENT DOCUMENTS

| | | | | |
|---|---|---|---|---|
| 5,339,844 | A | 8/1994 | Stanford, Jr. et al. | 134/107 |
| 5,412,958 | A | 5/1995 | Iliff et al. | 68/5 |
| 5,434,332 | A | 7/1995 | Cash | 588/1 |
| 5,467,492 | A | 11/1995 | Chao et al. | 8/159 |
| 5,630,434 | A | 5/1997 | Gray et al. | 134/10 |
| 5,651,276 | A | 7/1997 | Purer et al. | 68/5 |
| 5,669,251 | A | 9/1997 | Townsend et al. | 68/58 |
| 5,676,705 | A | 10/1997 | Jureller et al. | 8/142 |
| 5,683,473 | A | 11/1997 | Jureller et al. | 510/286 |
| 5,683,977 | A | 11/1997 | Jureller et al. | 510/286 |
| 5,766,637 | A | 6/1998 | Shine et al. | 424/497 |
| 5,784,905 | A | 7/1998 | Townsend et al. | 68/13 |
| 5,822,818 | A | 10/1998 | Chao et al. | 8/158 |
| 5,858,022 | A | 1/1999 | Romack et al. | 8/142 |
| 5,904,737 | A * | 5/1999 | Preston et al. | 8/158 |
| 5,908,510 | A | 6/1999 | McCullough et al. | 134/2 |
| 5,925,192 | A | 7/1999 | Purer et al. | 134/10 |
| 5,937,675 | A | 8/1999 | Stucker | 68/18 |
| 5,943,721 | A | 8/1999 | Lerette et al. | 8/158 |
| 5,946,945 | A | 9/1999 | Kegler et al. | 68/18 |
| 5,961,671 | A | 10/1999 | Guindy et al. | 29/623.1 |
| 5,968,285 | A | 10/1999 | Ferrell et al. | 134/26 |
| 5,970,554 | A | 10/1999 | Shore et al. | 8/158 |
| 5,976,264 | A | 11/1999 | McCullough et al. | 134/2 |
| 5,977,045 | A | 11/1999 | Murphy | 510/289 |
| 5,996,155 | A | 12/1999 | Chao et al. | 8/158 |
| 6,012,307 | A | 1/2000 | Malchow | 68/183 |
| 6,050,112 | A | 4/2000 | Walker | 68/12.21 |
| 6,070,440 | A | 6/2000 | Malchow et al. | 68/139 |
| 6,082,150 | A | 7/2000 | Stucker | 68/18 R |
| 6,212,916 | B1 | 4/2001 | Carr | 68/18 R |
| 6,216,302 | B1 * | 4/2001 | Preston et al. | 8/158 |
| 6,260,390 | B1 | 7/2001 | Carr | 68/18 R |
| 6,360,392 | B1 | 3/2002 | Malchow | 8/159 |
| 6,397,421 | B1 * | 6/2002 | Brainard et al. | 8/158 |
| 6,481,247 | B1 | 11/2002 | Fedegari | |

FOREIGN PATENT DOCUMENTS

| | | | |
|---|---|---|---|
| EP | 0 828 020 A2 | | 3/1998 |
| EP | 0 828 020 A3 | | 3/1998 |
| EP | 0 846 799 | | 6/1998 |
| EP | 0 919 659 A2 | | 6/1999 |
| JP | 10024270 A | * | 1/1998 |
| WO | WO 97/33031 | | 9/1997 |
| WO | WO 99/10587 | | 3/1999 |
| WO | WO 99/13148 | | 3/1999 |
| WO | WO9913148 | | 3/1999 |
| WO | WO 99/49122 | | 9/1999 |
| WO | WO 99/57358 | | 11/1999 |

OTHER PUBLICATIONS

International Search Report for Int'l Appl. No. PCT/US99/06383, dated Jul. 22, 1999.

Barton, Jerome C., "The Los Alamos Super Scrub™: Supercritical Carbon Dioxide System Utilities and Consumables Study," *Los Alamos National Laboratory*, LA-12786, UC-321, Issued Jun. 1994.

Spall, Dale W., et al., "Precision Cleaning with Supercritical Carbon Dioxide for the Elimination of Organic Solvents and the Reduction of Hazardous Waste," *Los Alamos National Laboratory*, Submitted to: 9th Annual Aerospace Hazardous Materials Management Conference, Denver, CO, Sep. 28-30, 1994.

Williams, Sarah B. et al. "Elimination of Solvents and Waste by Supercritical Carbon Dioxide in Precision Cleaning," *Los Alamos National Laboratory*, Submitted to: American Chemical Society Emerging Technologies in Hazardous Management VI, Atlanta, GA, Sep. 19-21, 1994.

Williams, Sarah B. et al. "Fabric Compatibility and Cleaning Effectiveness of Drycleaning with Carbon Dioxide," *Los Alamos National Laboratory*, Presentation at European Drycleaning Conference, Milan Italy, Mar. 9-16, 1996.

Japanese Patent Office electronic translation of JP10024270A, published Jan. 27, 1998, 28 pages.

US 6,001,133, 12/1999, DeYoung et al. (withdrawn)

* cited by examiner

CLEANING APPARATUS HAVING MULTIPLE WASH TANKS FOR CARBON DIOXIDE DRY CLEANING AND METHODS OF USING SAME

RELATED APPLICATIONS

This application is a division of U.S. application Ser. No. 09/669,154, filed Sep. 25, 2000, now U.S. Pat. No. 6,589,592, which is a continuation in part of U.S. application Ser. No. 09/405,619, filed Sep. 24, 1999, now U.S. Pat. No. 6,314,601.

FIELD OF THE INVENTION

This invention relates to methods and apparatus for cleaning systems, and more particularly to methods and apparatus for carbon dioxide dry cleaning systems having multiple wash tanks.

BACKGROUND OF THE INVENTION

Organic solvents such as perchloroethylene and other low-pressure liquid solvents have long been popular for use in cleaning systems such as dry cleaning systems. Recently, however, there are growing concerns that these solvents may harm the environment and pose occupational safety hazards. These concerns have led to an extensive search for alternative solvents that are less hazardous and systems for applying such solvents.

Some of this research has focused on systems utilizing solvents that are gases at low pressure. These systems may operate either under subcritical conditions such that the solvent is present as a liquid or under supercritical conditions such that the solvent is present as a supercritical fluid. Some of these systems utilize liquid carbon dioxide ($CO_2$) as a cleaning solvent.

PCT Publication WO 99/13148 to Shore et al. describes a cleaning system using liquid $CO_2$. Shore describes evacuating a cleaning chamber to remove air from the chamber. Shore also discusses filling the chamber with carbon dioxide gas from either a distillation vessel or a liquid $CO_2$ storage tank as part of a prefill mode. Shore further describes how draining liquid carbon dioxide from the cleaning chamber leaves carbon dioxide gas in the chamber and discusses an apparatus for reclaiming this gas using a compressor and a condenser to return reliquified CO2 to a liquid storage tank.

The system described by Shore is inefficient making it expensive to operate and expensive to construct. For example, filling the cleaning chamber with CO2 gas from a distillation vessel requires that a distillation vessel be supplied and operated. Alternatively, using vaporization of the liquid CO2 in the storage tank requires the storage tank to contain a heater sized to provide make-up heat equal to the heat of vaporization of the liquid CO2 that is converted to vapor.

Furthermore, a condenser must be supplied which is sized to handle the extreme vapor loads experienced at the beginning of the vapor reclamation operation. Additionally, cooling must be supplied to this condenser. Other methods for removing the CO2 gas from the cleaning chamber such as venting to atmosphere, which results in loss of CO2 from the system, or sparging as described in PCT Publication WO 97/33031 to Taricco are similarly inefficient.

A small amount of air in the system may be beneficial, providing a partial pressure in the liquid CO2 storage tank and resulting in increased net positive suction head for the pump. However, the efficiency of the condenser can be drastically affected by even small amounts of air. Thus, a vacuum pump must be operated before each cycle to ensure that all air has been evacuated from the cleaning chamber.

Further inefficiencies occur in carbon dioxide cleaning systems that employ cleaning solutions comprising liquid carbon dioxide and other additives or detergents. To create a source of liquid CO2, these systems rely on evaporators or stills to separate additives and contaminants from the cleaning solution and generate CO2 vapor. Such stills and evaporators require heating elements, which must be sized to supply sufficient CO2 vapor and operated using steam or electricity.

SUMMARY OF THE INVENTION

The present invention provides a cleaning apparatus having multiple wash tanks for washing articles in a carbon dioxide dry cleaning system employing a liquid carbon dioxide cleaning solution. Cleaning apparatus having multiple wash tanks of the present invention may improve the thermodynamic efficiency of a liquid carbon dioxide dry cleaning system by allowing carbon dioxide vapor to be transferred between wash tanks rather than being condensed. Cleaning apparatus having multiple wash tanks of the present invention may share one or more components between the multiple wash tanks. For example, cleaning apparatus having multiple wash tanks of the present invention may have only one pump, one compressor, one working tank, one condenser, one control cabinet, one chiller, one soap injection system, one distillation system, and one vacuum system while providing the washing capacity of multiple cleaning systems each having a single wash tank. Thus, cleaning apparatus having multiple wash tanks of the present invention may have a lower capital cost than several single wash tank apparatus that do not share one or more components.

Cleaning apparatus of the present invention having multiple wash tanks for washing articles in a carbon dioxide dry cleaning system employing a liquid carbon dioxide cleaning solution include a first wash tank for contacting a first article with liquid carbon dioxide cleaning solution, and a second wash tank for contacting a second article with liquid carbon dioxide cleaning solution. The second wash tank is in fluid communication with the first wash tank.

In embodiments of the present invention, the apparatus may include a working tank for storing liquid carbon dioxide cleaning solution. The working tank may be in fluid communication with at least one of the first wash tank and the second wash tank. The apparatus may include a first piping system that provides liquid communication between the first wash tank, the second wash tank, and the working tank. The apparatus may include a pump for transferring liquid carbon dioxide cleaning solution between the first wash tank, the second wash tank, and the working tank. The pump may reside in the first piping system. The apparatus may include a second piping system that provides vapor communication between the first wash tank and the second wash tank. The apparatus may include a compressor for transferring carbon dioxide vapor between the first wash tank and the second wash tank. The compressor may reside in the second piping system. The apparatus may include a condenser for condensing carbon dioxide vapor to liquid carbon dioxide. The condenser may be in fluid communication with the first wash tank, the second wash tank and the working tank.

In still other embodiments, the apparatus may include a vapor tank for storing carbon dioxide vapor. The vapor tank may be in fluid communication with at least one of the first wash tank and the second wash tank. The apparatus may include a first piping system that provides vapor communication between the first wash tank, the second wash tank, and the vapor tank. The apparatus may include a compressor for transferring carbon dioxide vapor between the first wash tank, the second wash tank, and the vapor tank. The compressor may reside in the first piping system. The apparatus may include a second piping system that provides liquid communication between the first wash tank and the second wash tank. The apparatus may include a pump for transferring liquid carbon dioxide cleaning solution between the first wash tank and the second wash tank. The pump may reside in the second piping system. The apparatus may include a condenser for condensing carbon dioxide vapor to liquid carbon dioxide. The condenser may be in fluid communication with the first wash tank, the second wash tank, and the vapor tank.

In yet other embodiments, the apparatus may include a third wash tank for contacting a third article with liquid carbon dioxide cleaning solution. The third wash tank may be in fluid communication with at least one of the first wash tank and the second wash tank. The apparatus may include a first piping system that provides vapor communication between the first wash tank, the second wash tank, and the third wash tank. The apparatus may include a compressor for transferring carbon dioxide vapor between the first wash tank, the second wash tank, and the third wash tank. The compressor may reside in the first piping system. The apparatus may include a second piping system that provides liquid communication between the first wash tank, the second wash tank, and the third wash tank. The apparatus may include a pump for transferring liquid cleaning solution between the first wash tank, the second wash tank, and the third wash tank. The pump may reside in the second piping system.

According to the present invention, methods of washing articles using a carbon dioxide dry cleaning system employing a liquid carbon dioxide dry cleaning solution include removing carbon dioxide vapor from a first wash tank, and charging at least a portion of the carbon dioxide vapor into a second wash tank.

In embodiments of the present invention, the method may include transferring liquid carbon dioxide cleaning solution from a working tank to the second wash tank, washing a first article in the second wash tank, and transferring liquid carbon dioxide cleaning solution from the second wash tank to the working tank. The operation of charging at least a portion of the carbon dioxide vapor into a second wash tank may precede the operation of transferring liquid carbon dioxide cleaning solution from a working tank to the second wash tank. The method may include unloading a first washed article from the first wash tank, and loading a second article into the first wash tank. The operation of removing carbon dioxide vapor from the first wash tank may precede the operation of unloading a first washed article from the first wash tank. The operations of unloading a first washed article from the first wash tank and loading a second article in the first wash tank may occur during one or more of the operations of transferring liquid carbon dioxide cleaning solution from a working tank to the second wash tank, washing a first article in the second wash tank, and transferring liquid carbon dioxide cleaning solution from the first wash tank to the working tank.

In still other embodiments of the present invention, the operations of removing carbon dioxide vapor from a first wash tank and charging at least a portion of the carbon dioxide vapor into a second wash tank may include transferring carbon dioxide vapor from the first wash tank having a higher pressure to the second wash tank having a lower pressure utilizing a piping system, pumping the carbon dioxide vapor out of the first wash tank using a compressor when the differential pressure between the first wash tank and the second wash tank is less than about 100 psig, condensing a portion of the carbon dioxide vapor into liquid carbon dioxide in a condenser, storing the liquid carbon dioxide in a working tank, and stopping the compressor when the pressure in the wash tank is less than about 100 psig. The operation of removing carbon dioxide vapor from the first wash tank may include venting carbon dioxide from the first wash tank to atmosphere.

In yet other embodiments of the present invention, the method includes removing carbon dioxide vapor from the second wash tank, and charging at least a portion of the carbon dioxide vapor into the first wash tank. The operation of transferring liquid carbon dioxide cleaning solution from the second wash tank to the working tank may precede the removing of carbon dioxide vapor from the second wash tank.

According to the present invention, methods of washing articles using a carbon dioxide dry cleaning system employing a liquid carbon dioxide dry cleaning solution include transferring liquid carbon dioxide cleaning solution from a first wash tank to a second wash tank, removing carbon dioxide vapor from the first wash tank to a vapor tank, storing the carbon dioxide vapor in the vapor tank, and charging the first wash tank with carbon dioxide vapor from the vapor tank.

In embodiments of the present invention, the method may include washing a first article in the second wash tank. At least a portion of the operation of washing a first article in the second wash tank may occur during one or more of the operations of removing carbon dioxide vapor from the first wash tank to a vapor tank, storing the carbon dioxide vapor in the vapor tank, and charging the first wash tank with carbon dioxide vapor from the vapor tank.

In other embodiments of the present invention, the method may include unloading a first washed article from the first wash tank, and loading a second article into the first wash tank. The operations of unloading a first washed article from the first wash tank and loading a second article into the first wash tank may occur during the operation of storing the carbon dioxide vapor in the vapor tank.

In still other embodiments, the method may include transferring liquid carbon dioxide from the second wash tank to the first wash tank, removing carbon dioxide vapor from the second wash tank to the vapor tank, storing the carbon dioxide vapor in the vapor tank, and charging the second wash tank with carbon dioxide vapor from the vapor tank. The operation of charging the second wash tank with carbon dioxide vapor from the vapor tank may precede the operation of transferring liquid carbon dioxide cleaning solution from the second wash tank to the first wash tank.

According to the present invention, methods of washing articles using a carbon dioxide dry cleaning system employing a liquid carbon dioxide cleaning solution include transferring liquid carbon dioxide cleaning solution from a first wash tank to a second wash tank, removing carbon dioxide vapor from the first wash tank, and charging at least a portion of the carbon dioxide vapor into a third wash tank.

In embodiments of the present invention, the method may include washing a first article in the second wash tank. The method may include transferring liquid carbon dioxide cleaning solution from the first wash tank to the third wash tank, removing carbon dioxide vapor from the second wash tank, and charging at least a portion of the carbon dioxide vapor removed from the second wash tank into the first wash tank. The operation of washing a first article in the second wash tank may precede the transferring of liquid carbon dioxide cleaning solution from the second wash tank to the third wash tank.

In other embodiments of the present invention, the method may include washing a second article in the third wash tank, transferring liquid carbon dioxide cleaning solution from the third wash tank to the first wash tank, removing carbon dioxide vapor from the third wash tank, and charging at least a portion of the carbon dioxide vapor into the second wash tank.

According to other embodiments of the present invention, coating apparatus having multiple coating tanks and methods of using such apparatus are also provided.

Methods and apparatus according to the present invention may therefore improve the thermodynamic efficiency of and reduce the capital costs associated with liquid carbon dioxide dry cleaning systems. It will be understood that the present invention may be embodied as methods and apparatus and combinations thereof.

DETAILED DESCRIPTION OF PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. As used herein, "fluid communication" means liquid and/or vapor communication. As used herein, "densified gas" means a liquid fluid that is gaseous at ambient conditions (e.g., 25° C. and atmospheric pressure). Examples include carbon dioxide, helium, nitrogen, air, methane, ethane, propane, butane, ammonia, and nitrous oxide. Preferably, the densified gas is carbon dioxide.

Figure 1:
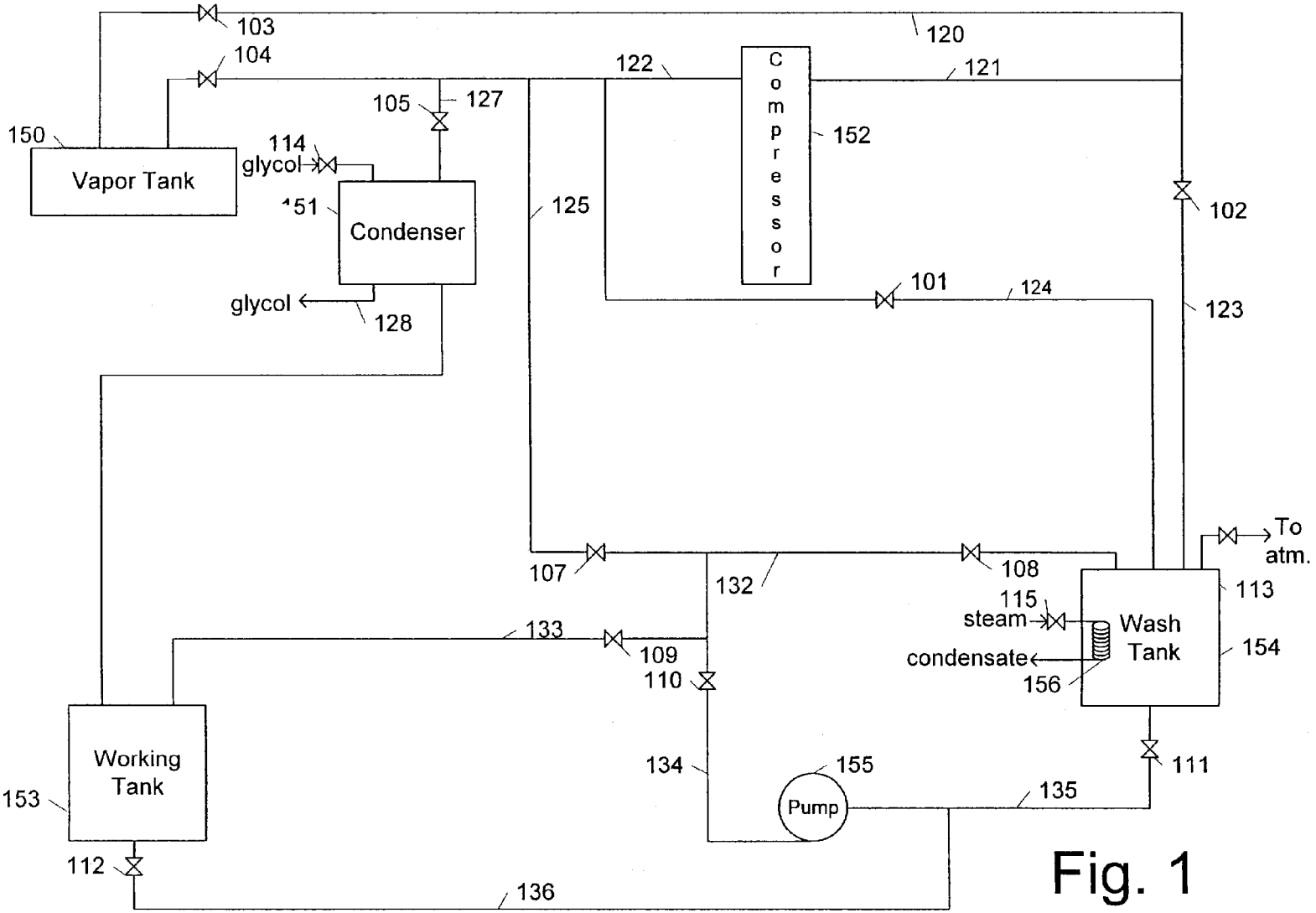
FIG. 1 illustrates a carbon dioxide dry cleaning system employing a vapor tank according to the present invention.

Referring first to FIG. 1, a wash cycle will be described, focusing particularly on charging carbon dioxide vapor into and removing carbon dioxide vapor from wash tank 154. In general, a wash cycle may be performed in the following steps: (1) placing clothes to be cleaned into wash tank 154; (2) charging carbon dioxide vapor into wash tank 154 to pressurize it; (3) transferring liquid cleaning solution, comprising liquid carbon dioxide as a solvent, from working tank 153 to wash tank 154 via pump 155; (4) washing clothes in wash tank 154; (5) draining liquid cleaning solution from wash tank 154 and transferring liquid cleaning solution via pump 155 back to working tank 153; (6) extracting remaining liquid cleaning solution from clothes in wash tank 154; (7) removing carbon dioxide vapor from wash tank 154 to depressurize it; and (8) removing clean clothes from wash tank 154. For illustrative purposes, this description will begin in the middle of a wash cycle, at the washing step, and end at the washing step in the next wash cycle. Valves 101–115 are shut, compressor 152 and pump 155 are secured, and system pressure and temperature are at or near saturated conditions for the given cleaning solution, preferably between about 55 to 62° F. (10 to 17° C.) at between about 681 to 756 psig for a carbon dioxide based system. One who is skilled in the art will understand that carbon dioxide dry cleaning systems can be operated at a variety of pressures and temperatures.

After washing clothes in wash tank 154 for a sufficient amount of time, the liquid cleaning solution may be drained from wash tank 154 by opening valves 109, 110, 111, 101, and 105 starting pump 155, which transfers the liquid cleaning solution from wash tank 154 through lines 135, 134, and 133 back to working tank 153. Once the liquid cleaning solution is transferred, pump 155 is secured and valves 109, 110, 111, 101, and 105 are shut. One who is skilled in the art will appreciate that lines may be selected from a group comprising piping, conduit, and other means of fluid communication that can withstand system temperature and pressure. Piping for the system is preferably schedule 40, stainless steel, and conforms to ANSI standards B31.3. One who is skilled in the art will also understand that a piping system may be comprised of one or more lines and that zero or more valves may reside in the one or more lines.

Any remaining liquid cleaning solution may be mechanically or otherwise extracted from the clothes in wash tank 154, and the remaining liquid cleaning solution may be drained from wash tank 154 using the drain procedure outlined above. At this point, the atmosphere in wash tank 154 is comprised primarily of carbon dioxide vapor.

Once the liquid cleaning solution has been drained, the carbon dioxide vapor in wash tank 154 may be removed to a vapor tank as follows, depressurizing wash tank 154 and allowing clean clothes to be removed. Valves 101 and 104 are opened, allowing the carbon dioxide vapor to move from wash tank 154 through lines 124 and 122 to vapor tank 150. Vapor tank 150 preferably has a volume of about 6 to about 60 $ft^3$ (about 0.17 to about 1.7 $m^3$). One skilled in the art will be able to select appropriate tanks to withstand system pressure and temperature by using, for example, the ASME Pressure Vessel Code. Valve 101 and line 124 may be sized to provide adequate restriction to the vapor flow to limit the velocity of this gas stream when the differential pressure between wash tank 154 and vapor tank 150 is at its greatest, about 700 psig or greater. Valve 101 is preferably a ½"

full-flow ball valve, model #8450 commercially available from Watts Regulator Company of N. Andover, Mass. Line 124 is preferably a 1" schedule 40, stainless steel pipe conforming to ANSI standards B31.3. One who is skilled in the art could select a suitable valve to limit the flow rate resulting from other pressure differentials.

When this differential pressure has been reduced sufficiently, preferably less than 200 psi differential, valves 102 and 103 may be opened to facilitate vapor transfer by providing an additional flow path through lines 123 and 120. When the pressure differential between wash tank 154 and vapor tank 150 has been reduced such that it is less then about 100 psig, preferably less than about 50 psig, more preferable at or near zero, valves 101 and 103 are shut and compressor 152 is started. Compressor 152 pumps carbon dioxide vapor from wash tank 154 through lines 123, 121, and 122 to vapor tank 150. When the pressure in wash tank 154 is at or near atmospheric pressure, preferably less than about 100 psig, more preferably less than about 50 psig, compressor 152 is secured and valves 102 and 104 are shut. Any vapor remaining in wash tank 154 may be vented through valve 113. Wash tank 154 is now depressurized and clean clothes may be removed from it.

As just described, draining a solution comprising liquid carbon dioxide out of wash tank 154 may result in carbon dioxide vapor remaining in wash tank 154. Removing most if not all of this carbon dioxide vapor to a vapor tank rather than condensing it to liquid carbon dioxide conserves the carbon dioxide vapor for reuse in charging wash tank 154 at the beginning of a cycle. Thus, use of the vapor tank may eliminate the need for a condenser and may reduce the capital and operating costs of the cleaning system. Furthermore, conserving the carbon dioxide vapor for reuse in charging the wash tank at the beginning of a cycle may improve the thermodynamic efficiency of the system. Additionally, which may reduce or eliminate the need to remove air from the system at the beginning of each wash cycle. Thus, the need for a vacuum pump may be reduced or even eliminated resulting in lower capital costs and operating expenses. Furthermore, higher concentrations of air in the system may increase the efficiency of the system by providing a partial pressure in the head-space of the working tank, resulting in increased net positive suction head for a pump.

While compressor 152 may be used to remove all or almost all of the carbon dioxide vapor from wash tank 154 as just described, this process may be somewhat inefficient. As the pressure in vapor tank 150 builds, the compressor 152 reaches high compression ratios and the vapor transfer rate through compressor 152 decreases. Thus, compressor 152 may have to run for a long time to remove all or nearly all of the vapor from wash tank 154, resulting in energy and time inefficiencies. The vapor removal step described above may be augmented to utilize condenser 151, partially if not completely eliminating these inefficiencies by reducing the pressure in vapor tank 150 as follows. When the pressure differential between wash tank 154 and vapor tank 150 has been reduced sufficiently, preferably less than about 100 psig, more preferably less than 50 psig, most preferably at or near zero, valves 101 and 104 are shut and compressor 152 is started. Valve 114 is opened and condenser 151 is brought on-line. The remaining vapor in wash tank 154 is transferred through lines 123, 121, and 122 to vapor tank 150. Valve 105 is opened and some of the vapor flowing through line 122 begins to flow through line 127, condense in condenser 151, and flow as liquid through line 128 into working tank 153. When the pressure in wash tank 154 is at or near atmospheric pressure, preferably less than about 100 psig, most preferably less than about 50 psig, compressor 152 is secured and valves 102, 104, 105, and 114 are shut. Any vapor remaining in wash tank 154 may be vented through valve 113. Wash tank 154 is now depressurized and clean clothes may be removed from it.

A condenser must be sized to provide sufficient cooling during peak load conditions. By utilizing condenser 151 to condense only a portion of the carbon dioxide vapor removed from wash tank 154 rather than all or almost all of the vapor, the size of condenser 151 may be drastically reduced because the peak load experienced by the condenser has been drastically reduced. This embodiment may therefore result in lower capital and operating costs.

As carbon dioxide vapor is removed from wash tank 154 as described above, the temperature within wash tank 154 may decrease as the vapor expands. This temperature decrease may cause frozen carbon dioxide, commonly known as dry ice, to form on the clothes in wash tank 154. To reduce or eliminate this cooling effect, it may be desirable to heat the contents of wash tank 154 as the vapor is removed. Heat is preferably supplied using heating element 156 by opening valve 115; however, one skilled in the art will know other ways of providing heat to wash tank 154.

At the beginning of the next wash cycle, clothes to be cleaned may be placed into wash tank 154, which is at atmospheric pressure. As mentioned above, the cleaning solution in working tank 154 is at or near saturated conditions, preferably between about 55 to 62° F. (10 to 17° C.) at between about 681 to 756 psig for a carbon dioxide based system. The pressure differential between working tank 153 and wash tank 154, roughly 700 psig, may be reduced to facilitate safely transferring liquid cleaning solution to wash tank 154 by charging conserved carbon dioxide vapor from vapor tank 150 into wash tank 154 to pressurize it.

Wash tank 154 may be pressurized by charging the conserved carbon dioxide vapor from vapor tank 150 to wash tank 154 as follows. Valves 104 and 101 are opened, allowing vapor to move from vapor tank 150 through lines 122 and 124 to wash tank 154. Valve 101 and line 124 may be sized to provide adequate restriction to the vapor flow to limit the velocity of this gas stream when the differential pressure between vapor tank 150 and wash tank 154 is at its greatest. When this differential pressure has been reduced sufficiently, preferably less than 200 psi differential, valves 103 and 102 may be opened to facilitate vapor transfer by providing an additional flow path through lines 120 and 123. When the pressure differential between wash tank 154 and vapor tank 150 has been reduced such that it is at or near zero, valves 104 and 102 are shut and compressor 152 is started. Compressor 152 pumps conserved carbon dioxide vapor from vapor tank 150 through lines 121, 121, and 124 to wash tank 154 until the differential pressure between working tank 153 and wash tank 154 has been reduced such that it is less than about 300 psig, preferably less than 200 psig, more preferably less than or equal to 100 psig. Then, compressor 152 is secured and valves 103 and 101 are shut. Alternatively, only valve 101 could be shut, keeping valve 103 open and compressor 152 running to facilitate transfer of cleaning solution from the working tank 153 to wash tank 154 as described below. Wash tank 154 has now been pressurized such that the differential pressure between wash tank 154 and working tank 153 is at or near zero and cleaning solution may be transferred safely from working tank 153 to wash tank 154.

Charging conserved carbon dioxide vapor from vapor tank 150 to wash tank 154 rather than generating vapor by vaporizing cleaning solution in an evaporator, still, or storage tank may eliminate the need for an evaporator, a still, or a heating element in the storage tank. Thus, the present invention may reduce capital costs and operating expenses and may be more thermodynamically efficient.

While compressor 152 may be used to pump the remaining conserved carbon dioxide vapor from vapor tank 150 to pressurize wash tank 154 as just described, this process may be somewhat inefficient. As the pressure in wash tank 154 builds, the compressor 152 reaches high compression ratios and the vapor transfer rate through compressor 152 decreases. Thus, compressor 152 may have to run for a long time to pressurize wash tank 154 completely or nearly completely, resulting in energy and time inefficiencies. The vapor charging step described above may be augmented as follows, partially if not completely eliminating these inefficiencies. When the pressure differential between wash tank 154 and vapor tank 150 has been reduced such that it is at or near zero, valves 104 and 102 are shut and compressor 152 is started. Compressor 152 pumps conserved carbon dioxide vapor from vapor tank 150 through lines 121, 121, and 124 to wash tank 154. When compressor 152 begins to reach high compression ratios, valve 105 is opened. Vapor pressure in working tank 153 drops and cleaning solution in working tank 153 begins to boil. Vapor from working tank 153 flows through line 128, through condenser 151 which is off-line, and through line 127 where this vapor joins the flow of vapor in line 122 coming from the compressor 152 and flows into the wash tank through line 124. When the differential pressure between working tank 153 and wash tank 154 has been reduced such that it is at or near zero, compressor 152 is secured and valves 103, 105, and 101 are shut. Wash tank 154 has now been pressurized such that the differential pressure between wash tank 154 and working tank 153 is at or near zero and cleaning solution may be transferred safely from working tank 153 to wash tank 154.

By supplying only a portion rather than all of the carbon dioxide vapor by vaporizing the cleaning solution in working tank 153, the heat that must be supplied to the cleaning solution to make-up for heat lost due to vaporization may be reduced. Thus, the present invention may reduce capital costs and operating expenses and may be more thermodynamically efficient.

Cleaning solution may be transferred from working tank 153 to wash tank 154 by opening valves 112, 110, 108, 101, and 105 and starting pump 155. Cleaning solution moves from working tank 153 through lines 136, 135, 134, and 132 into wash tank 154. When a sufficient amount of cleaning solution has been transferred, pump 155 is secured and valves 112, 110, 108, 101, and 105 are shut. While cleaning solution is being transferred from working tank 153 to wash tank 154, the pressure in vapor tank 150 may be reduced by opening valves 103 and 105, bringing condenser 151 on-line by opening valve 114 and starting compressor 152. This pressure may be reduced to better prepare vapor tank 150 to receive vapor during the next cycle. When pressure in vapor tank 150 has been reduced to preferably less than 100 psig, most preferably less than 50 psig, compressor 152 is secured and valves 103, 105, and 114 are shut.

Alternatively, cleaning solution may be transferred using compressor 152 instead of pump 155. To accomplish this transfer, compressor 152 is allowed to continue running after the differential pressure between vapor tank 150 and wash tank 154 has been reduced such that it is at or near zero. When the outlet pressure of compressor 152 is slightly higher than the pressure in working tank 153, valve 101 is shut and valve 105 is opened such that the outlet pressure from compressor 152 pressurizes the vapor space in working tank 153. Of course, condenser 151 is not providing cooling to the vapor in line 127 because valve 114 is closed. With working tank 153 now under additional pressure, valves 112 and 111 are opened. Cleaning solution is transferred from working tank 153 to wash tank 154 through lines 136 and 135. When a sufficient amount of cleaning solution has been transferred, compressor 152 is secured and valves 112, 111, 105, and 103 are shut. Washing clothes in wash tank 154 is commenced.

Similarly, solution may be transferred from wash tank 154 to working tank 153 using the compressor. Vapor from vapor tank 150 may be transferred to wash tank 154 to raise the pressure in wash tank 154 above that of working tank 153 by opening valves 103 and 101 and starting compressor 152. Solution may then be transferred from wash tank 154 to working tank 153 by opening valves 111 and 112. When the desired amount of solution has been transferred, valves 111 and 112 may be shut, compressor 152 may be secured, and valves 101 and 103 may be shut.

In an alternative embodiment, two dry cleaning systems may be interconnected such that vapor tank 150 is a wash tank for a second system, which may have its own compressor, condenser, pump, and working tank, or preferably share some or all of these components with the first system. When wash tank 150 in the first system is depressurized as described above, the conserved carbon dioxide vapor pressurizes the wash tank in the second system. Thus, these two systems may work together such that the wash cycles are 180° out of phase. For example, when one system is contacting clothes with cleaning solution, the wash tank in the other system may be emptied.

The temperature of the system may increase for a number of reasons, including, but not limited to, heat input from pumping cleaning solution, heat input from ambient and heat input from warming clothes in wash tank 154. It may be desirable to cool down the system for several reasons including maintaining optimal system conditions and preventing overpressure.

Cleaning solution in wash tank 154 may be cooled by transferring vapor from wash tank 154 to condenser 151, condensing the vapor there, and transferring the liquid carbon dioxide to working tank 153. Transferring vapor from wash tank 154 may cause the pressure in wash tank 154 to drop slightly, which may cause vaporization of some of liquid cleaning solution, resulting in removal of heat due to the heat of vaporization of the boiled liquid. The quantity of vapor transferred may be small enough that the differential pressure between wash tank 154 and condenser 151 should provide sufficient driving force to move the vapor. Additionally, the quantity of cleaning solution vaporized may be small enough that no cleaning solution need be added back to the wash tank. Vapor may be transferred by opening valves 101, 105, and 114 causing vapor to flow through lines 124, 122, and 127, condense in condenser 151, and flow as liquid through line 128 into working tank 153. When the solution in wash tank 154 has been sufficiently cooled, valves 101, 105, and 114 may be shut.

Similarly, cleaning solution in working tank 153 may be cooled by transferring vapor from working tank 153 to condenser 151, condensing the vapor there, and returning the liquid carbon dioxide to working tank 154 as follows. Valve 114 may be opened, bringing condenser 151 on-line and allowing vapor in line 128 to condense. When the solution in working tank 153 has been sufficiently cooled, valve 114 may be shut.

Alternatively, vapor from wash tank 154 may be transferred to vapor tank 150, which may be maintained at a pressure sufficiently below the pressure of wash tank 154 such that the pressure differential between the two tanks drives vapor flow. During a wash cycle, vapor tank 150 is preferably maintained at a pressure less than about 300 psig. Vapor transfer may be performed by opening valves 101 and 104. When the cleaning solution in wash tank 154 reaches the desired temperature, valves 101 and 104 can be shut. The vapor thus transferred may be transferred to condenser 151 using compressor 152 and the resulting liquid carbon dioxide returned to working tank 153 by opening valves 103, 105, and 114 and starting compressor 152 causing vapor to flow through lines 121, 123, 121, 122, and 127, condense in condenser 151 and flow as liquid through line 128 into working tank 153. When the desired amount of vapor has been transferred compressor 152 can be secured and valves 103, 104, and 114 shut.

Similarly, vapor may be transferred from working tank 153 to vapor tank 150 to provide desired cooling to solution in working tank 153 as follows. With valve 114 shut, such that condenser 151 is off-line, valves 105 and 104 may be opened, transferring vapor from working tank 153, which is at a higher pressure, to vapor tank 150, which is at a lower pressure. Preferably, working tank 153 is at system pressure described above and vapor tank is at a pressure less than system pressure, preferably less than 500 psig, more preferably less than 300 psig. Transferring vapor from working tank 153 may cause the pressure in working tank 153 to drop slightly, which may cause vaporization of some of the liquid cleaning solution, resulting in removal of heat due to the heat of vaporization of the boiled liquid. This vapor may be condensed and returned to the working tank as described above.

Figure 2:
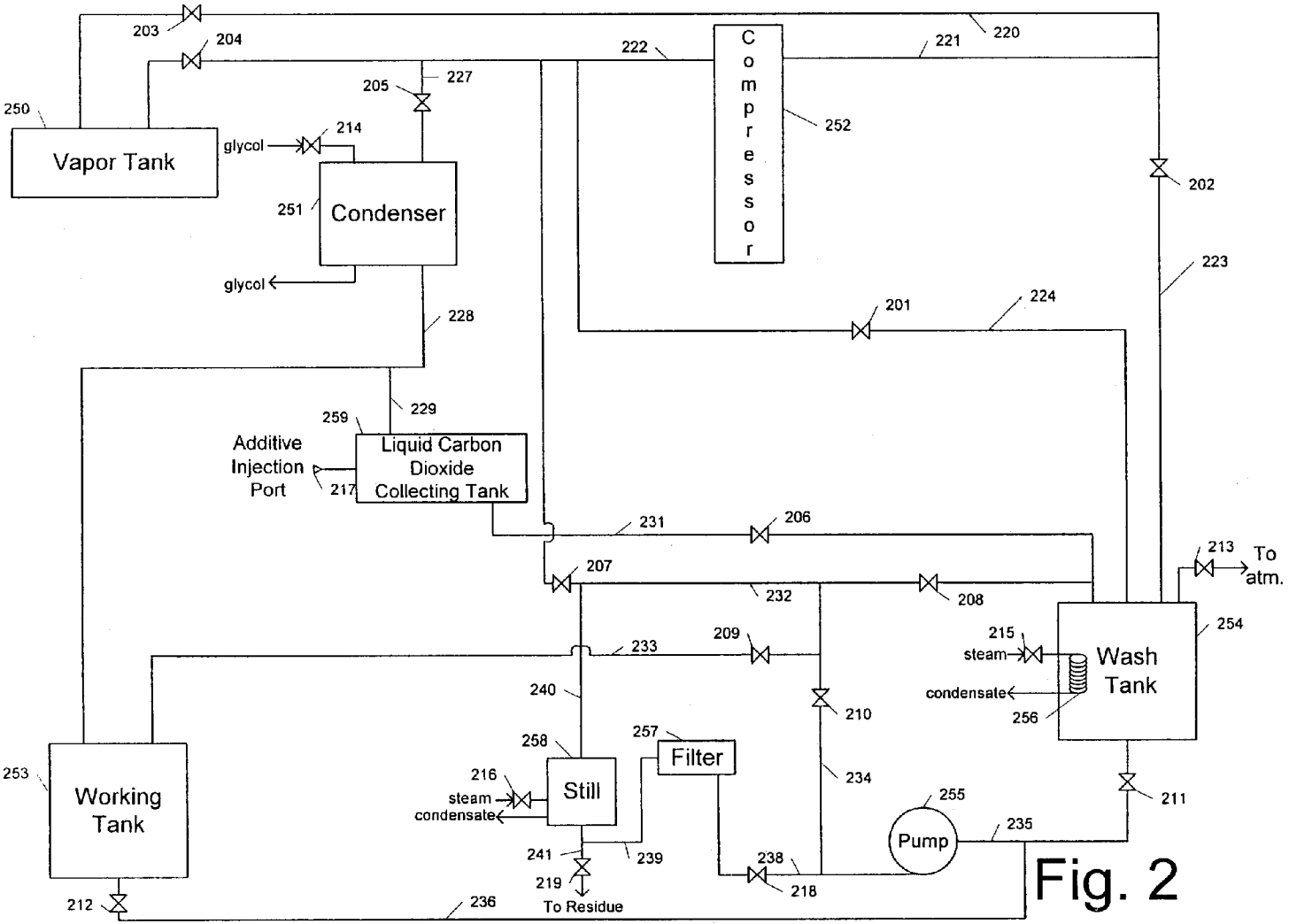
FIG. 2 illustrates a carbon dioxide dry cleaning system employing a vapor tank and a liquid carbon dioxide collecting tank according to the present invention.

Referring now to FIG. 2, a carbon dioxide dry cleaning system employing a vapor tank and a liquid carbon dioxide collecting tank will now be described. Valves 201–215, lines 225–241, and equipment 250–253 correspond to valves 101–115, lines 120–136, and equipment 150–156 in FIG. 1. Additionally, a wash cycle for the system shown in FIG. 2 occurs as described above for the system shown in FIG. 1.

Liquid carbon dioxide collecting tank 259 collects liquid $CO_2$, which may then be used in a variety of ways described below. Liquid carbon dioxide collecting tank 259 has an inlet line 229 and an outlet line 231. Inlet line 229 is connected to line 228, the outlet to condenser 251, such that when liquid flows through line 228 from condenser 251 to working tank 253, the liquid is diverted to liquid carbon dioxide collecting tank 259. Outlet line 231 runs between liquid carbon dioxide collecting tank 259 and wash tank 254. In a preferred embodiment, the elevation of liquid carbon dioxide collecting tank 259 is higher than that of wash tank 254 such that fluid in liquid carbon dioxide collecting tank 259 may be gravity fed through line 231 into wash tank 254 by opening valves 206, 205, and 201. Liquid carbon dioxide collecting tank 259 should have a sufficient volume to perform desired procedures such as rinsing the contents of wash tank 254 or washing filter 257. Liquid carbon dioxide collecting tank preferably has a capacity of about 5 to about 30 gallons and more preferably has a capacity of about 5 to about 15 gallons. When liquid carbon dioxide collecting tank 259 is full, its excess contents may spill out through lines 229 and 228 into working tank 253.

Liquid carbon dioxide collecting tank 259 may be filled with liquid $CO_2$ from a number of different sources either individually or in combination including the following. One source of liquid $CO_2$ may be working tank reflux. The cleaning solution in working tank 253 may heat up due to heat transfer into the tank from higher ambient temperatures. If this happens, the cleaning solution may begin to boil. Vapor will travel from the vapor space in working tank 253 through line 228 into condenser 251. When valve 214 is open and condenser 251 is on-line, the vapor condenses and flows back down line 228 as liquid $CO_2$. This liquid $CO_2$ will flow through line 229 into liquid carbon dioxide collecting tank 259. Another source of liquid $CO_2$ may be the $CO_2$ that condenses during the vapor removal step described above for the system in FIG. 1 where valve 214 is opened and condenser 251 is brought on-line, valve 205 is opened and some of the vapor flowing through line 222 begins to flow through line 227, condense in condenser 251, and flow as liquid through line 228. This liquid $CO_2$ flows into liquid carbon dioxide collecting tank 259. Yet another source of liquid $CO_2$ may be $CO_2$ condensed from distillation of cleaning solution in still 258. Cleaning solution may be transferred to still 258 and distilled to separate the $CO_2$ solvent from surfactants and contaminants among other things. Cleaning solution is transferred by opening valves 211, and 218 and starting pump 255. When the desired amount of cleaning solution has been transferred, pump 255 is secured and valves 210-and 212 are shut. The cleaning solution in still 258 is distilled by opening valve 216, bringing still 258 on-line. Valve 214 is opened and condenser 251 is brought on-line, then valves 207 and 205 are opened and vapor flows from still 258 through lines 240, 232, 222, and 227 into condenser 251 where it condenses. Liquid $CO_2$ then flows through lines 228 and 229 into liquid carbon dioxide collecting tank 259. Still another source of liquid $CO_2$ may be wash tank reflux that occurs when liquid in wash tank 254 is heated by opening valve 215, bringing heating element 256 on-line. Valve 214 is opened and condenser 251 is brought on-line, then valves 208, 207, and 205 are opened. Vapor flows from wash tank 254 through lines 232, 222, and 227 into condenser 251 where it condenses. The liquid $CO_2$ flows through lines 228 and 229 into liquid carbon dioxide collecting tank 259. Another source of liquid CO2 may be vapor transfer from vapor tank 250 after a system cooling procedure has been performed as described above for the system in FIG. 1.

Liquid $CO_2$ in liquid carbon dioxide collecting tank 259 may be used to rinse clothes in wash tank 254 as follows. Liquid carbon dioxide collecting tank 259 has been filled with liquid $CO_2$ as described above. A wash cycle, as described above for the system in FIG. 1, proceeds through the extraction step. Valves 206, 205, and 201 are opened allowing the contents of the liquid carbon dioxide collecting tank 259, in this case liquid $CO_2$, to flow through line 231 into wash tank 254. When the desired amount of liquid $CO_2$ has been added to wash tank 254, valves 206, 205, and 201 are shut. Clothes in wash tank 254 are contacted with the liquid $CO_2$ for a sufficient amount of time to rinse any residual cleaning solution from the clothes. The drain and extraction steps described above for the system in FIG. 1 are then repeated to remove the rinse solution from wash tank 254, and the carbon dioxide vapor in wash tank 254 may be removed as described above for the system in FIG. 1. Liquid carbon dioxide collecting tank 259 may be refilled by one of the methods described above.

Liquid in liquid carbon dioxide collecting tank 259 may be used to wash filter 257. One who is skilled in the art will appreciate that the cleaning system could include one or more than one filter in many different configurations. Liquid carbon dioxide collecting tank 259 has been filled with liquid carbon dioxide as described above. A wash of the filter may be performed as a periodic operation. In the preferred embodiment, a wash may be performed on a weekly basis, more preferred for commercial operations at a time when cleaning operations are not scheduled. The filter wash may be initiated by employees as they leave for the day. The cycle would commence and follow a normal wash cycle, as described above for the system in FIG. 1, through the vapor charging step with the exception that no clothes would be added to wash tank 154. During this time, additives may be added to the liquid $CO_2$ in liquid carbon dioxide collecting tank 259 through additive injection port 217 to form a filter wash solution. These additives may shift the adsorption equilibrium of adsorbed dyes or other contaminants such that they become soluble in liquid carbon dioxide. The precise additive needed to clean filter 257 will depend on the type of contaminant to be removed from it and will be known to those skilled in the art. If no additives are added to liquid carbon dioxide collecting tank 259, the filter wash solution consists of liquid carbon dioxide.

The contents of liquid carbon dioxide collecting tank 259 are added to wash tank 254 by opening valves 206, 205, and 201, allowing the filter wash solution to flow through line 231. When the desired amount of filter wash solution has been transferred to wash tank 254, valves 206, 205, and 201 are shut. Valves 211, 218, and 208 are opened and pump 255 is started. Filter wash solution is circulated from wash tank 254 through lines 235 and 238, through filter 257, through lines 239 and 241, through still 258, which is off-line, and through lines 240 and 232 back to wash tank 254. After washing filter 257 for a sufficient amount of time, preferably between about 1 and 600 minutes, most preferably between 1 and 20 minutes, the filter wash solution may be transferred either to working tank 254 or to still 258. Filter wash solution may be transferred to working tank 254 by shutting valve 208 and opening valves 209, 201, and 205. When wash tank 254 is empty, pump 255 is secured and valves 211, 218, 209, 201, and 205 are shut. Alternatively, filter wash solution may be transferred from wash tank 254 to still 258 by shutting valve 208. When wash tank 254 is empty, pump 255 is secured and valves 218 and 211 are shut. Filter 257 may be positioned at an elevation above still 258 so that filter 257 may be drained into still 258 by gravity. The filter wash solution may then be distilled by opening valves 207 and 205, then opening valves 216 and 214, bringing the still and the condenser on-line. Vapor from the still travels through lines 240, 232, 222, 227, condenses in condenser 251, then liquid carbon dioxide travels through line 228 into liquid carbon dioxide collecting tank 259. When the contents of still 258 have been distilled, valves 216, 214, 207, and 205 are shut. Carbon dioxide vapor in wash tank 254 may be removed as described above for the system in FIG. 1. Liquid carbon dioxide collecting tank 259 may be refilled by one of the methods described above.

Liquid in liquid carbon dioxide collecting tank 259 may be used to help remove non-volatile residues present on clothes in wash tank 254 after the wash cycle. Liquid carbon dioxide collecting tank 259 has been filled with liquid $CO_2$ as described above. A wash cycle, as described above for the system in FIG. 1, proceeds through the extraction step. Before the vapor removal step, a second extraction step may be performed as follows. Valves 206, 205, and 201 are opened allowing the contents of the liquid carbon dioxide collecting tank 259, in this case liquid $CO_2$, to flow through line 231 into wash tank 254. Clothes in wash tank 254 are contacted with the liquid $CO_2$ for a sufficient amount of time to remove some or all of the remaining non-volatile residues from the clothes. During this time, heating element 256 is brought on-line by opening valve 215. As the liquid in wash tank 254 boils, the carbon dioxide vapor created condenses on the cooler clothes that are in wash tank 254, which may extract the residues. The condensed carbon dioxide vapor falls back to the bottom of wash tank 254 and may be reboiled. After this second extraction step has been performed for a sufficient time, heating element 256 is taken off-line by shutting valve 215. The drain and extraction steps described above for the system in FIG. 1 may be repeated to remove the liquid from wash tank 254. Wash tank 254 may be depressurized as described above for the system in FIG. 1. Liquid carbon dioxide collecting tank 259 may be refilled by one of the methods described above.

As described above with reference to FIG. 1, embodiments of the present invention may include two dry cleaning systems that are interconnected such that the vapor tank is a wash tank for the second system. The second system may have its own compressor, condenser, pump, and working tank, or preferably share some or all of these components with the first system. These and other embodiments will now be further described with reference to FIGS. 3 through 10.

Figure 3:
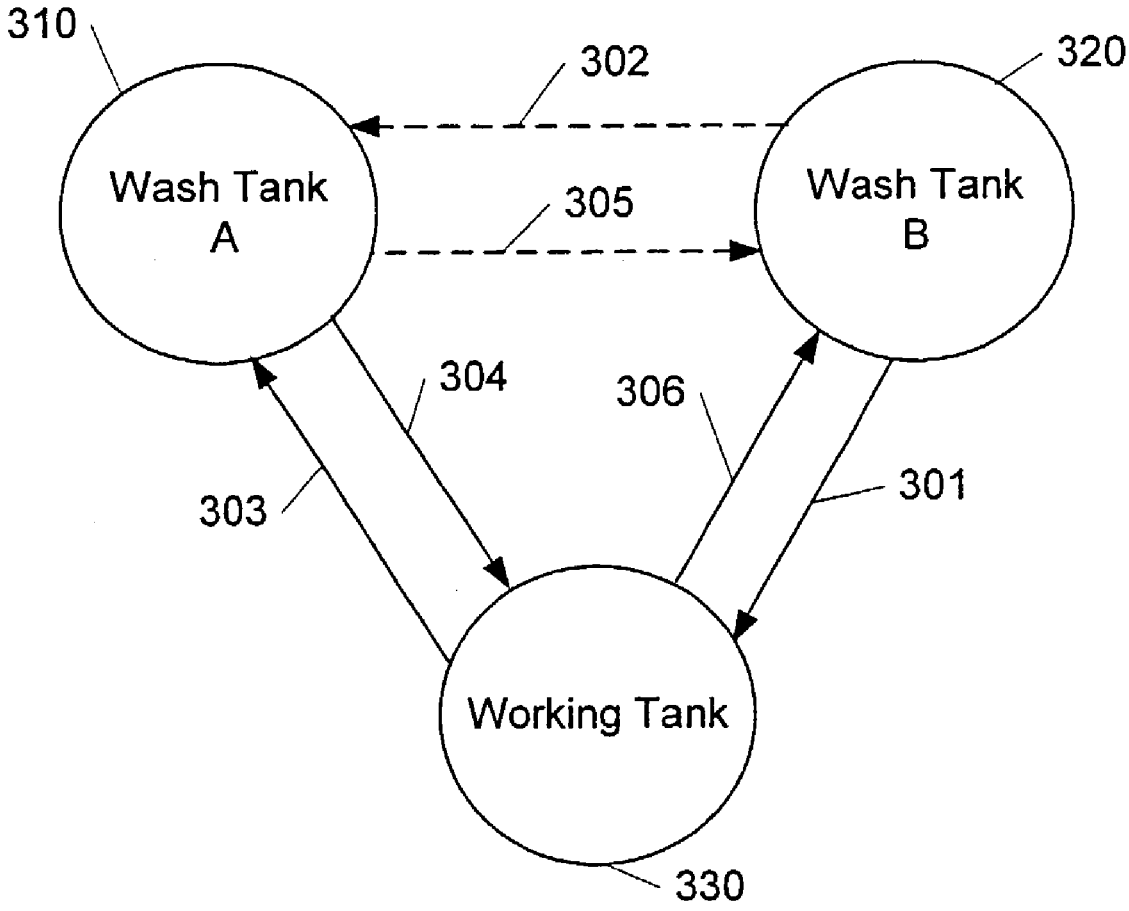
FIG. 3 illustrates the fluid flow in a cleaning apparatus according to the present invention having two wash tanks and a working tank.

Referring now to FIG. 3, the fluid flow in a cleaning apparatus according to the present invention having two wash tanks and a working tank will now be described. Wash tank A 310 is in fluid communication with wash tank B 320 and working tank 330. Wash tank B 320 is in fluid communication with working tank 330. The initial state of the system is as follows. Clothes are being loaded into wash tank A 310. Wash tank B 320 is washing clothes with the liquid cleaning solution described above with reference to FIG. 1. Dashed lines indicate vapor fluid flow and solid lines indicate liquid fluid flow.

As used herein, the term "wash tank" refers to a tank that is capable of performing a washing operation. Thus, a wash tank preferably includes an agitation means, such as a rotating basket, flow nozzles, etc., and an access means (e.g., a door capable of forming a pressure barrier) that allows clothes to be placed into and removed from the wash tank. An exemplary wash tank is described in U.S. Pat. No. 6,049,931 to McClain et al. Other wash tanks are discussed in U.S. Pat. No. 5,467,492 to Chao et al.; U.S. Pat. No. 5,651,276 to Purer et al.; U.S. Pat. No. 5,669,251 to Townsend et al.; and U.S. Pat. No. 5,943,721 to Lerette et al., for example.

After washing clothes in wash tank B, liquid cleaning solution is transferred from wash tank B 320 to working tank 330 as illustrated by line 301. Carbon dioxide vapor remains in wash tank B 320. The carbon dioxide vapor remaining in wash tank B 320 is removed from wash tank B 320 and charged into wash tank A 310 as shown by line 302. Wash tank B 320 is now depressurized. Washed clothes are unloaded from wash tank B 320 and clothes are loaded into wash tank B 320. Wash tank A 310 is now pressurized and ready to receive liquid cleaning solution from working tank 330. Liquid cleaning solution is transferred from working tank 330 to wash tank A 310 as illustrated by line 303.

The clothes in wash tank A 310 are washed. The liquid cleaning solution in wash tank A 310 is then transferred from wash tank A 310 to working tank 330 as illustrated by line 304. Carbon dioxide vapor remaining in wash tank A 310 is removed from wash tank A 310 and charged into wash tank B 320 as shown by dashed line 305. Wash tank A 310 is now depressurized. Washed clothes are unloaded from wash tank A 310 and clothes are loaded into wash tank A 310. Wash tank B 320 is now pressurized and ready to receive liquid cleaning solution from working tank 330. Liquid cleaning solution is transferred from working tank 330 to wash tank B 320 as illustrated by line 306.

Figure 4:
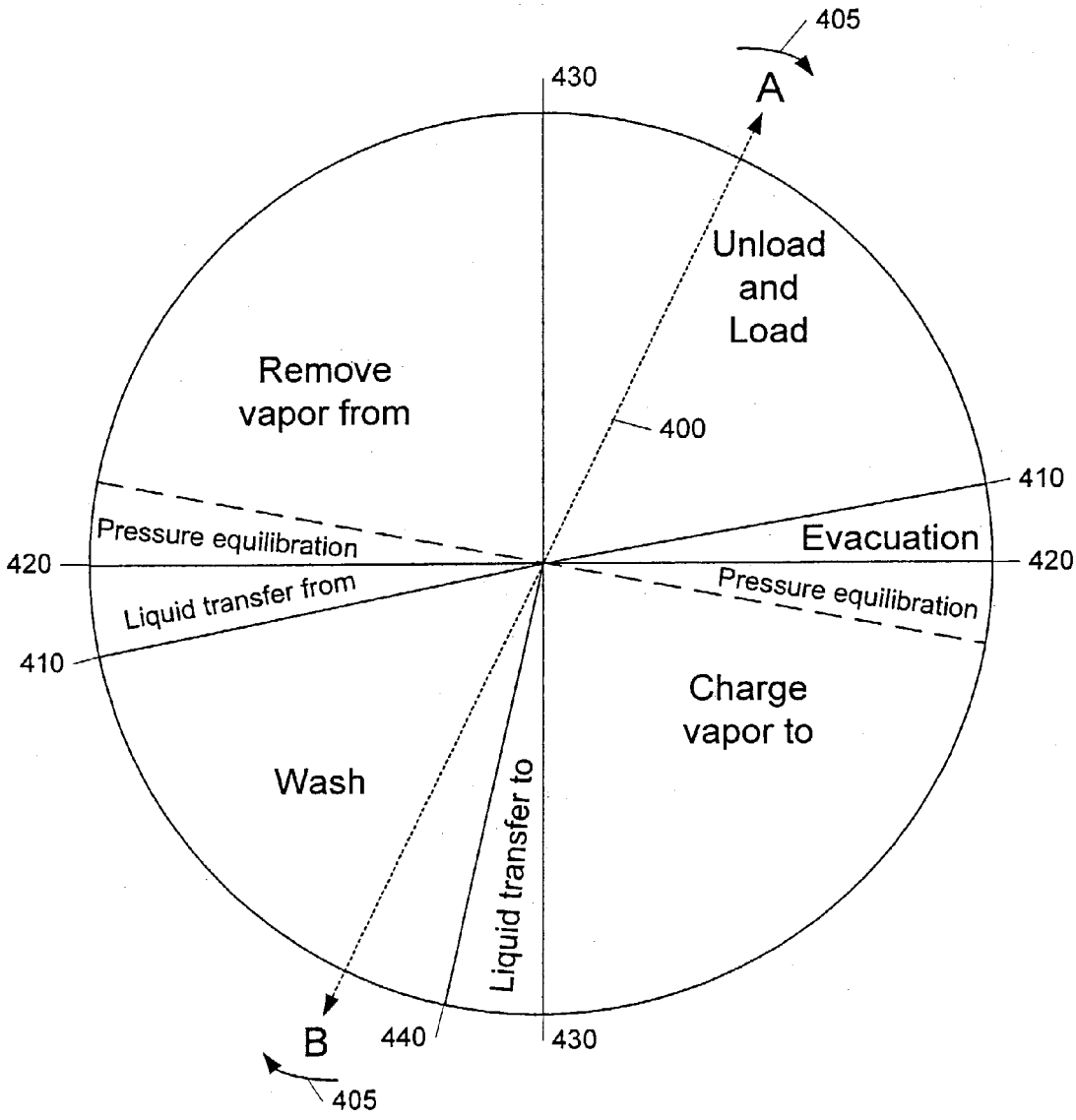
FIG. 4 illustrates a wash cycle for a cleaning apparatus according to the present invention having two wash tanks and a working tank.

Referring now to FIG. 4, embodiments of a timing relationship between the various operations described above with reference to FIG. 3 will now be described. Process line 400 represents the process state of a particular wash tank at a given point in time. Process line 400 has a first segment 400A and a second segment 400B. First segment 400A of process line 400 represents the process state of wash tank A at a given point in time. Second segment 400B of process line 400 represents the process state of wash tank B at a given point in time. As a wash cycle progresses, process line 400 rotates in a clockwise direction as indicated by arrows 405.

At the initial position of process line 400, washed clothes are being unloaded from and clothes are being loaded into wash tank A as clothes are being washed in wash tank B. When process line 400 reaches time 410, air is evacuated from wash tank A as liquid is transferred from wash tank B to the working tank. As used in describing FIGS. 3–10, "liquid transfer" from a wash tank may include draining liquid from the wash tank and extracting liquid from the clothes as described above with reference to FIG. 1. While it may be preferable that air be evacuated from a wash tank of the present invention prior to charging vapor into the wash tank, it is to be understood that air may be evacuated from some other point in the system, or may not be evacuated at all. When process line 400 reaches time 420, the evacuation operation and liquid transfer operations have been completed. While the embodiments of FIG. 4 show an evacuation operation and a liquid transfer from wash tank to working tank operation that begin and end at the same times, it is to be understood that evacuation operations and liquid transfer from wash tank to working tank operations may begin at different times and end at the same time, may begin at the same time and end at different times, or may begin and end at different times. For example, the evacuation operation may be completed in wash tank A before the liquid transfer from wash tank B to the working tank operation begins. If this occurs, wash tank A, which has been evacuated, may be held in an evacuated state until liquid has been transferred from wash tank B to the working tank.

Beginning at time 420, carbon dioxide vapor is removed from wash tank B and charged into wash tank A. The removing and charging operations preferably include pressure equilibration between wash tank A and wash tank B; however, as will be understood by those skilled in the art, the removing and charging operations may occur without such pressure equilibration. For example, carbon dioxide vapor could be removed from wash tank B to a vapor tank and then charged into wash tank A.

At time 430, the removing and charging operations are completed. Wash tank A is now pressurized. Liquid cleaning solution is transferred from the working tank to wash tank A. At time 440, liquid transfer to wash tank A is complete and clothes in wash tank A are washed. At time 430, wash tank B is depressurized. Washed clothes are unloaded from and clothes are loaded into wash tank B. The aforementioned operations are then repeated for each wash tank as process line 400 continues to rotate through the wash cycle. Although the embodiments of FIG. 4 show operations that include unloading and loading, it is to be understood that unloading operations may not be followed by loading operations. For example, washed clothes may be unloaded from wash tank B and wash tank B may be sealed to receive vapor from wash tank A without first loading clothes into wash tank B. In this scenario, wash tank B is acting as a vapor tank rather than as a wash tank. This may be desirable at the end of a work day when there are no more loads of laundry to clean for that day.

Figure 5:
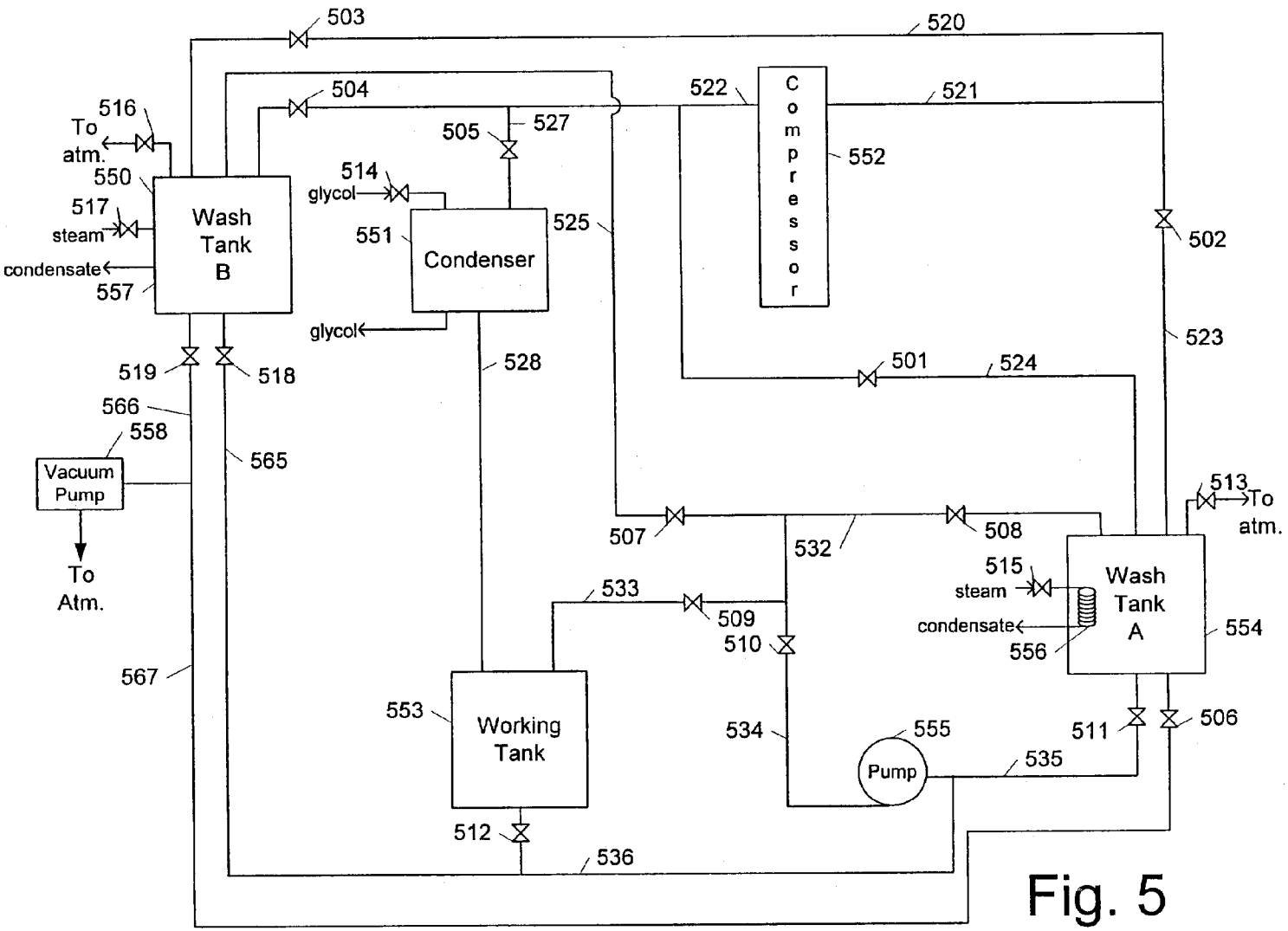
FIG. 5 illustrates a cleaning apparatus according to the present invention having two wash tanks and a working tank.

Referring now to FIG. 5, the wash cycle illustrated by the embodiments of FIG. 4 will be further described utilizing embodiments of a carbon dioxide dry cleaning system according to the present invention having two wash tanks and a working tank. Valves 501–505 and 508–514 correspond to valves 101–105 and 108–114 in FIG. 1. Lines 520–524, 527–528, and 532–536 correspond to lines 120–124, 127–128, and 132–136 in FIG. 1. Equipment 551–556 corresponds to equipment 151–156 in FIG. 1. Wash tank B 550, valves 516 and 517, and heating element 557 may be described and operate in substantially the same manner as wash tank 154, valves 113 and 115, and heating element 156 as described above with reference to FIG. 1 and will not be further described.

For illustrative purposes, the description of a wash cycle will begin with clothes being loaded into wash tank A 554 and clothes being washed in wash tank B 550. Valves 501–519 are shut, and compressor 552, pump 555, and vacuum pump 558 are secured. System pressure and temperature conditions are as described above with reference to FIG. 1.

After washing clothes in wash tank B 550 for a sufficient amount of time, the liquid cleaning solution may be drained from wash tank B 550 by opening valves 509, 510, 518, 504, and 505, and starting pump 555, which transfers the liquid cleaning solution from wash tank B 550 through lines 565, 536, 535, 534, and 533 back to working tank 553. Once the liquid cleaning solution is transferred, pump 555 is secured and valves 509, 510, 518, 504, and 505 are shut.

Any remaining liquid cleaning solution may be mechanically or otherwise extracted from the clothes in wash tank B 550, and the remaining liquid cleaning solution may be drained from wash tank B 550 using the drain procedure outlined above. At this point, the atmosphere in wash tank B 550 is comprised primarily of carbon dioxide vapor.

After clothes have been loaded into wash tank A 554, air in wash tank A 554 may be evacuated using vacuum pump 558 by opening valve 506 and starting vacuum pump 558. As described above with reference to FIG. 4, this evacuation operation may be performed while draining liquid cleaning solution from wash tank B 550. When the concentration of air in wash tank A 554 has been reduced sufficiently (e.g., pressure in wash tank A has reached about −12 psig), vacuum pump 558 may be secured and valve 506 may be shut.

Carbon dioxide vapor in wash tank B 550 may now be removed from wash tank B 550 and charged into wash tank A 554 as described above with reference to FIG. 1 for transferring carbon dioxide vapor from vapor tank 150 to wash tank 154. Once the vapor transfer operation is complete, liquid cleaning solution may be transferred from working tank 553 to wash tank A 554 as described above with reference to FIG. 1 for transferring liquid cleaning solution from working tank 153 to wash tank 154. Washed clothes may be unloaded from wash tank B 550 and clothes may be loaded into wash tank B 550. Air may be evacuated from wash tank B 550 by opening valve 519 and starting vacuum pump 558. As described above with reference to FIG. 4, this evacuation operation may be performed while draining liquid cleaning solution from wash tank A 554. When the concentration of air in wash tank B 550 has been reduced sufficiently, vacuum pump 558 may be secured and valve 519 may be shut.

After clothes in wash tank A 554 have been washed sufficiently, liquid cleaning solution may be drained from wash tank A 554 to working tank 553 as described above with reference to FIG. 1 for draining liquid cleaning solution from wash tank 154 to working tank 153. Carbon dioxide vapor in wash tank A 554 may be removed from wash tank A 554 and charged into wash tank B 550 as described above with reference to FIG. 1 for transferring carbon dioxide vapor from wash tank 154 to vapor tank 150. Washed clothes may then be unloaded from wash tank A 554.

Liquid cleaning solution may be transferred from working tank 553 to wash tank B 550 by opening valves 512, 510, 507, 504, and 505, and starting pump 555. Cleaning solution moves from working tank 553 through lines 536, 535, 534, and 525 into wash tank B 550. When a sufficient amount of cleaning solution has been transferred, pump 555 is secured and valves 512, 510, 507, 504, and 505 are shut. The clothes in wash tank B 550 may now be washed.

Figure 6:
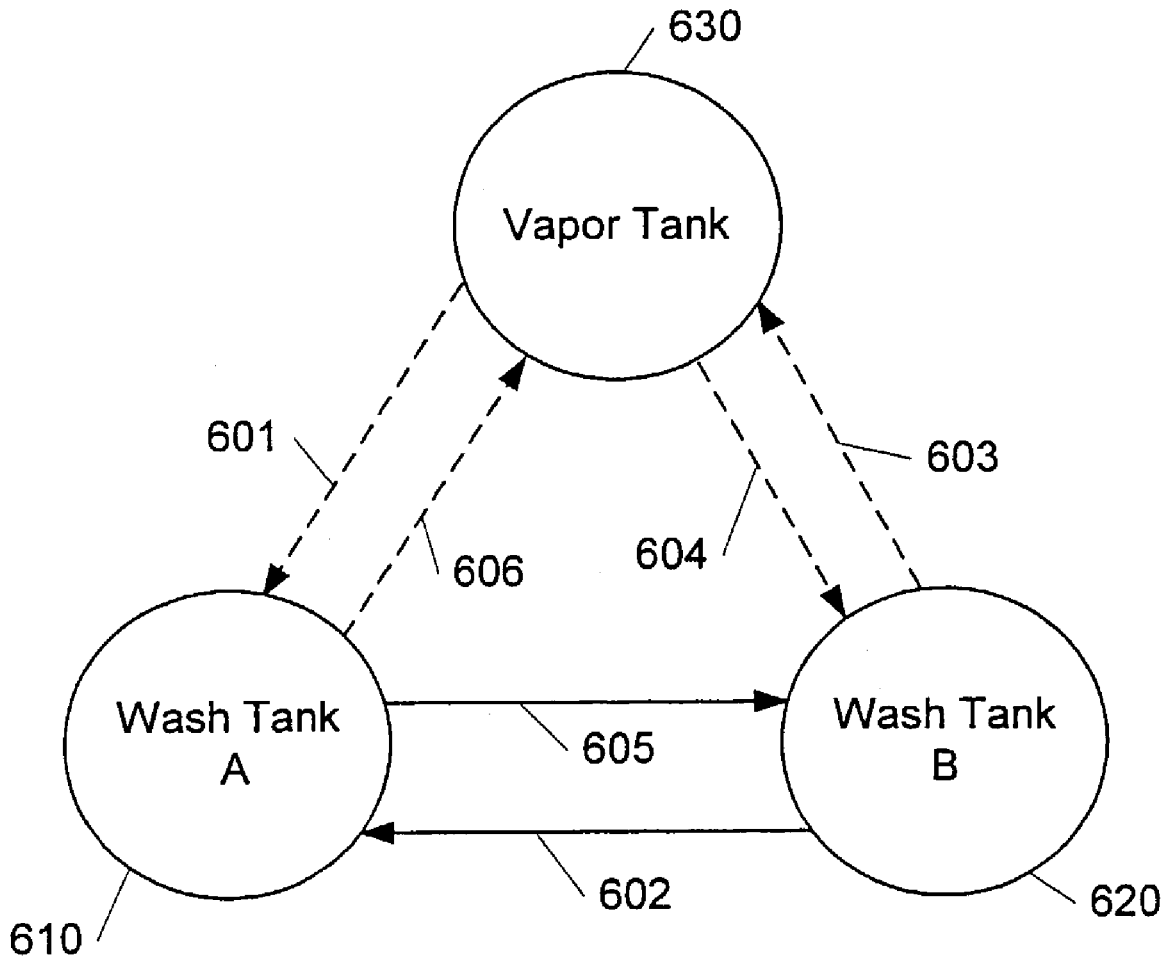
FIG. 6 illustrates the fluid flow in a cleaning apparatus according to the present invention having two wash tanks and a vapor tank.

Referring now to FIG. 6, the fluid flow in a cleaning apparatus according to the present invention having two wash tanks and a vapor tank will now be described. Wash tank A 610 is in fluid communication with wash tank B 620 and vapor tank 630. Wash tank B 620 is also in fluid communication with vapor tank 630. The initial state of the system is as follows. Clothes are being loaded into wash tank A 610. Wash tank B 620 is washing clothes with the liquid cleaning solution described above with reference to FIG. 1. Vapor tank 630 is storing carbon dioxide vapor. Dashed lines indicate vapor fluid flow and solid lines indicate liquid fluid flow.

After clothes are loaded into wash tank A 610, carbon dioxide vapor is charged from vapor tank 630 to wash tank A 610 as illustrated by line 601. Wash tank A 610 is now pressurized and ready to receive liquid cleaning solution from wash tank B 620. After the washing operation is completed in wash tank B 620, liquid cleaning solution is transferred from wash tank B 620 to wash tank A 610 as illustrated by line 602. Carbon dioxide vapor remains in wash tank B 620. The carbon dioxide vapor remaining in wash tank B 620 is removed from wash tank B 620 and stored in vapor tank 630 as illustrated by line 603. Wash tank B 620 is now depressurized. Washed clothes are unloaded from and clothes are loaded into wash tank B 620.

Carbon dioxide vapor is charged from vapor tank 630 to wash tank B 620 as illustrated by line 604. Wash tank B 620 is now pressurized and ready to receive liquid cleaning solution from wash tank A 610. After the washing operation is completed in wash tank A 610, liquid cleaning solution is transferred from wash tank A 610 to wash tank B 620 as illustrated by line 605. Carbon dioxide vapor remaining in wash tank A 610 is removed from wash tank A 610 and stored in vapor tank 630 as illustrated by line 606. Wash tank A 610 is now depressurized. Washed clothes are unloaded from wash tank A 610.

Figure 7:
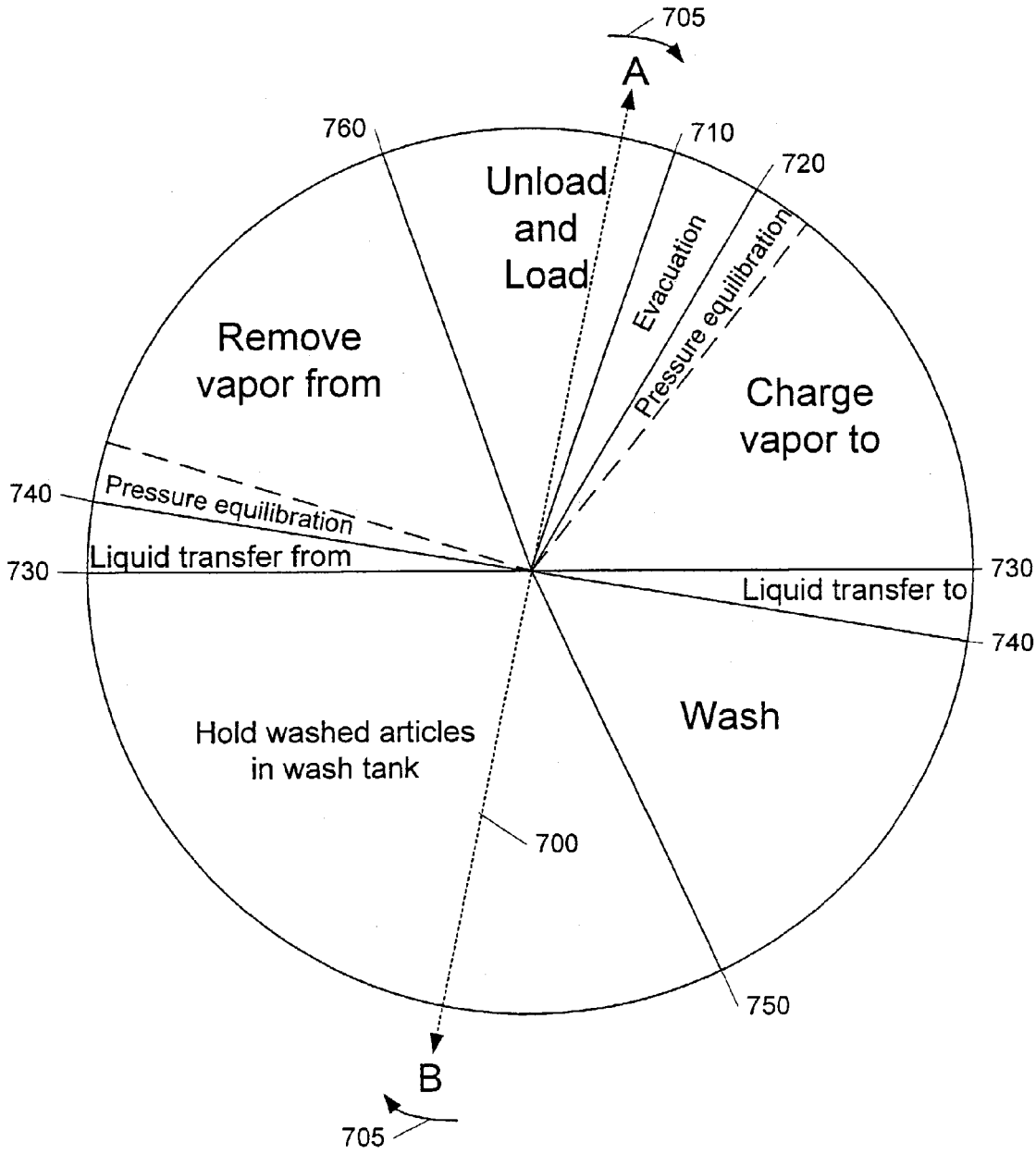
FIG. 7 illustrates a wash cycle for a cleaning apparatus according to the present invention having two wash tanks and a vapor tank.

Referring now to FIG. 7, embodiments of a timing relationship between the various operations described above with reference to FIG. 6 will now be described. Process line 700 represents the process state of a particular wash tank at a given point in time. Process line 700 has a first segment 700A and a second segment 700B. First segment 700A of process line 700 represents the process state for wash tank A at a given point in time. Second segment 700B of process line 700 represents the process state for wash tank B at a given point in time. As a wash cycle progresses, process line 700 rotates in a clockwise direction as indicated by arrows 705.

At the initial position of process line 700 washed clothes are being unloaded from and clothes are being loaded into wash tank A as washed clothes are being held in wash tank B. When process line 700 reaches time 710, air is evacuated from wash tank A. While it is preferable that air be evacuated from wash tanks prior to charging vapor into them, it is to be understood that air may be evacuated from some other point in the system, or may not be evacuated at all. When process line 700 reaches time 720, the evacuation operation is complete. Carbon dioxide vapor is charged into wash tank A from the vapor tank. The charging operation preferably includes pressure equilibration between wash tank A and the vapor tank. At time 730, wash tank A has been pressurized and is ready to receive liquid cleaning solution from wash tank B. Liquid cleaning solution is transferred from wash tank B to wash tank A. At time 740, liquid transfer from wash tank B to wash tank A is complete. Clothes in wash tank A are washed until time 750, and then held in wash tank A until time 730. Although the embodiments of FIG. 7 show that clothes are washed immediately after transferring liquid to wash tank A and then held in wash tank A after washing, it is to be understood that clothes may be held in wash tanks of the present invention prior to washing, for example in a pre-wash (soaking) operation, or may be washed from the time liquid is transferred into the wash tank until the time liquid is transferred out of the wash tank.

At time 740, carbon dioxide vapor is removed from wash tank B to the vapor tank. The removing operation preferably includes pressure equilibration between wash tank B and the vapor tank. At time 760, wash tank B is depressurized. Washed clothes are unloaded from and clothes are loaded into wash tank B. The aforementioned operations are then repeated for each wash tank as process line 700 continues to rotate through the wash cycle. While the embodiments of FIG. 7 show operations that include unloading and loading, it is to be understood that unloading operations may not be followed by loading operations. For example, washed clothes may be unloaded from wash tank B and wash tank B may receive vapor from the vapor tank and liquid from wash tank A without first loading clothes into wash tank B. In this scenario, wash tank B is acting as a working tank rather than as a wash tank. This may be desirable at the end of a work day when there are no more loads of laundry to clean for that day.

Figure 8:
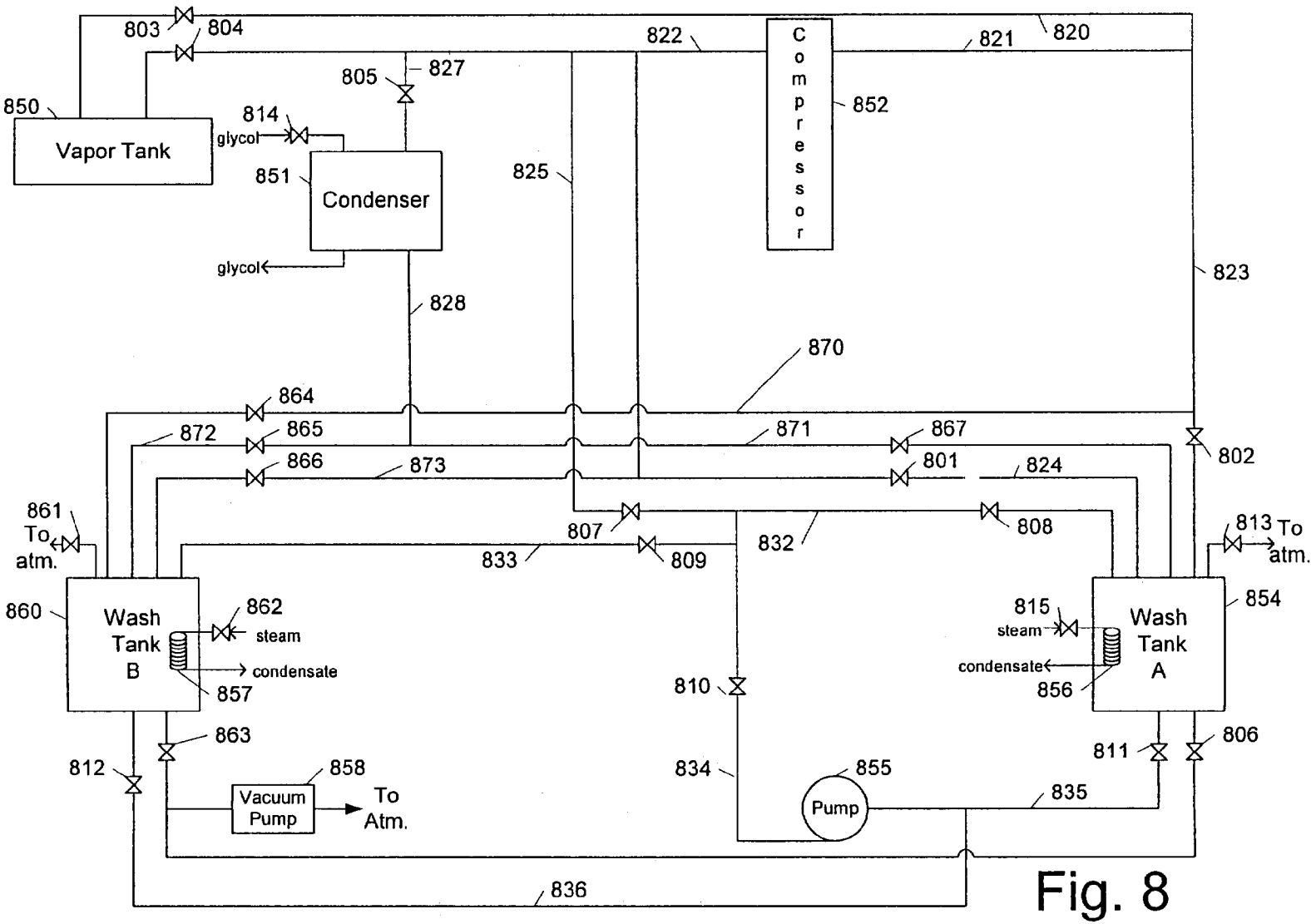
FIG. 8 illustrates a cleaning apparatus according to the present invention having two wash tanks and a vapor tank.

Referring now to FIG. 8, the wash cycle illustrated by the embodiments of FIG. 7 will be further described utilizing embodiments of a cleaning apparatus according to the present invention having two wash tanks and a working tank. Valves 801–805 and 807–814 correspond to valves 101–105 and 107–114 in FIG. 1. Lines 820–836 correspond to lines 120–136 in FIG. 1. Equipment 850–856 corresponds to equipment 150–156 in FIG. 1. Wash tank B 860, valves 861 and 862, and heating element 857 may be described and operate in substantially the same manner as wash tank 154, valves 113 and 115, and heating element 156 as described above with reference to FIG. 1 and will not be further described.

For illustrative purposes, the description of a wash cycle will begin with clothes being loaded into wash tank A 854. Washed clothes and liquid cleaning solution are being held in wash tank B 860. Valves 801–815 and 861–867 are shut, and compressor 852, pump 855, and vacuum pump 858 are secured. System pressure and temperature conditions are as described above with reference to FIG. 1.

After clothes have been loaded into wash tank A 854, air in wash tank A 854 may be evacuated using vacuum pump 858 by opening valve 806 and starting vacuum pump 858.

When the concentration of air in wash tank A 854 has been reduced sufficiently, vacuum pump 858 may be secured and valve 806 may be shut.

Carbon dioxide vapor may be transferred from vapor tank 850 to wash tank A 854 as described above with reference to FIG. 1 for transferring carbon dioxide vapor from vapor tank 150 to wash tank 154. After wash tank A 854 has been pressurized with carbon dioxide vapor from vapor tank 850, liquid cleaning solution may be transferred from wash tank B 860 to wash tank A 854 as follows. Valves 812, 810, 808, 801, and 866 are opened, and pump 855 is started, which transfers the liquid cleaning solution from wash tank B 860 through lines 836, 835, 834, and 832 to wash tank A 854. Once the liquid cleaning solution is transferred, pump 855 is secured and valves 812, 810, 808, 801, and 866 are shut. Any remaining liquid cleaning solution may be mechanically or otherwise extracted from the clothes in wash tank B 860, and the remaining liquid cleaning solution may be drained from wash tank B 860 using the drain procedure outlined above. At this point, the atmosphere in wash tank B 860 is comprised primarily of carbon dioxide vapor. After the liquid transfer operation is completed, the clothes in wash tank A 854 may be washed immediately or may be soaked and then washed.

Once the liquid cleaning solution has been drained, the carbon dioxide vapor in wash tank B 860 may be removed to vapor tank 850 as follows. Valves 866 and 804 are opened, allowing the carbon dioxide vapor to move from wash tank B 860 through lines 873 and 822 to vapor tank 850. Valve 866 and line 873 may be sized to provide adequate restriction to the vapor flow to limit the velocity of this gas stream when the differential pressure between wash tank B 860 and vapor tank 850 is at its greatest, about 700 psig or greater. Valve 866 is preferably a ½" full-flow ball valve, model #8450 commercially available from Watts Regulator Company of N. Andover, Mass. Line 873 is preferably a 1" schedule 40, stainless steel pipe conforming to ANSI standards B31.3. One who is skilled in the art could select a suitable valve to limit the flow rate resulting from other pressure differentials.

When this differential pressure has been reduced sufficiently, preferably less than 200 psi differential, valves 864 and 803 may be opened to facilitate vapor transfer by providing an additional flow path through lines 870, 823, and 820. When the pressure differential between wash tank B 860 and vapor tank 850 has been reduced such that it is less then about 100 psig, preferably less than about 50 psig, more preferable at or near zero, valves 866 and 803 are shut and compressor 852 is started. Compressor 852 pumps carbon dioxide vapor from wash tank B 860 through lines 870, 823, 821, and 822 to vapor tank 850. When the pressure in wash tank B 860 is at or near atmospheric pressure, preferably less than about 100 psig, more preferably less than about 50 psig, compressor 852 is secured and valves 864 and 804 are shut. Any vapor remaining in wash tank B 860 may be vented through valve 861. Wash tank B 860 is now depressurized and washed clothes may be removed from it. As described above with reference to FIG. 1, vapor transfer may be augmented using condenser 851 and lines 828 and 871 or 872.

Washed clothes are unloaded from wash tank B 860 and clothes are loaded into wash tank B 860. After clothes have been loaded into wash tank B 860, air in wash tank B 860 may be evacuated using vacuum pump 858 by opening valve 863 and starting vacuum pump 858. When the concentration of air in wash tank B 860 has been reduced sufficiently, vacuum pump 860 may be secured and valve 863 may be shut.

Wash tank B 860 may be pressurized by charging the conserved carbon dioxide vapor from vapor tank 850 to wash tank B 860 as follows. Valves 804 and 866 are opened, allowing vapor to move from vapor tank 850 through lines 822 and 873 to wash tank B 860. Valve 866 and line 873 may be sized to provide adequate restriction to the vapor flow to limit the velocity of this gas stream when the differential pressure between vapor tank 850 and wash tank B 860 is at its greatest. When this differential pressure has been reduced sufficiently, preferably less than 200 psi differential, valves 803 and 864 may be opened to facilitate vapor transfer by providing an additional flow path through lines 820, 823, and 870. When the pressure differential between wash tank B 860 and vapor tank 850 has been reduced such that it is at or near zero, valves 804 and 864 are shut and compressor 852 is started. Compressor 852 pumps carbon dioxide vapor from vapor tank 850 through lines 820, 821, 822, and 873 to wash tank B 860 until the differential pressure between wash tank A 854 and wash tank B 860 has been reduced such that it is less than about 100 psig, preferably less than about 50 psig, more preferably less than about 25 psig. Then, compressor 852 is secured and valves 803 and 866 are shut. Wash tank B 860 has now been pressurized such that the differential pressure between wash tank B 860 and wash tank A 854 is such that cleaning solution may be transferred safely from wash tank A 854 to wash tank B 860.

After wash tank B 860 is pressurized, liquid carbon dioxide cleaning solution may be transferred from wash tank A 854 to wash tank B 860 as follows. Valves 811, 810, 809, 801, and 866 are opened and pump 855 is started. Liquid cleaning solution is transferred from wash tank A 854 through lines 835, 834, and 833 to wash tank B 860. When the liquid cleaning solution has been transferred, pump 855 is secured and valves 811, 810, 809, 801, and 866 are shut. As will be understood by one skilled in the art, compressor 852 may be used to transfer liquid carbon dioxide solution as described above with reference to FIG. 1. The clothes in wash tank B 860 may now be washed.

Carbon dioxide vapor may be removed from wash tank A 854 and transferred to vapor tank 850 as described above with reference to FIG. 1 for transferring vapor from wash tank 154 to vapor tank 150. After wash tank A 854 has been depressurized, washed clothes may be removed from wash tank A 854.

Figure 9:
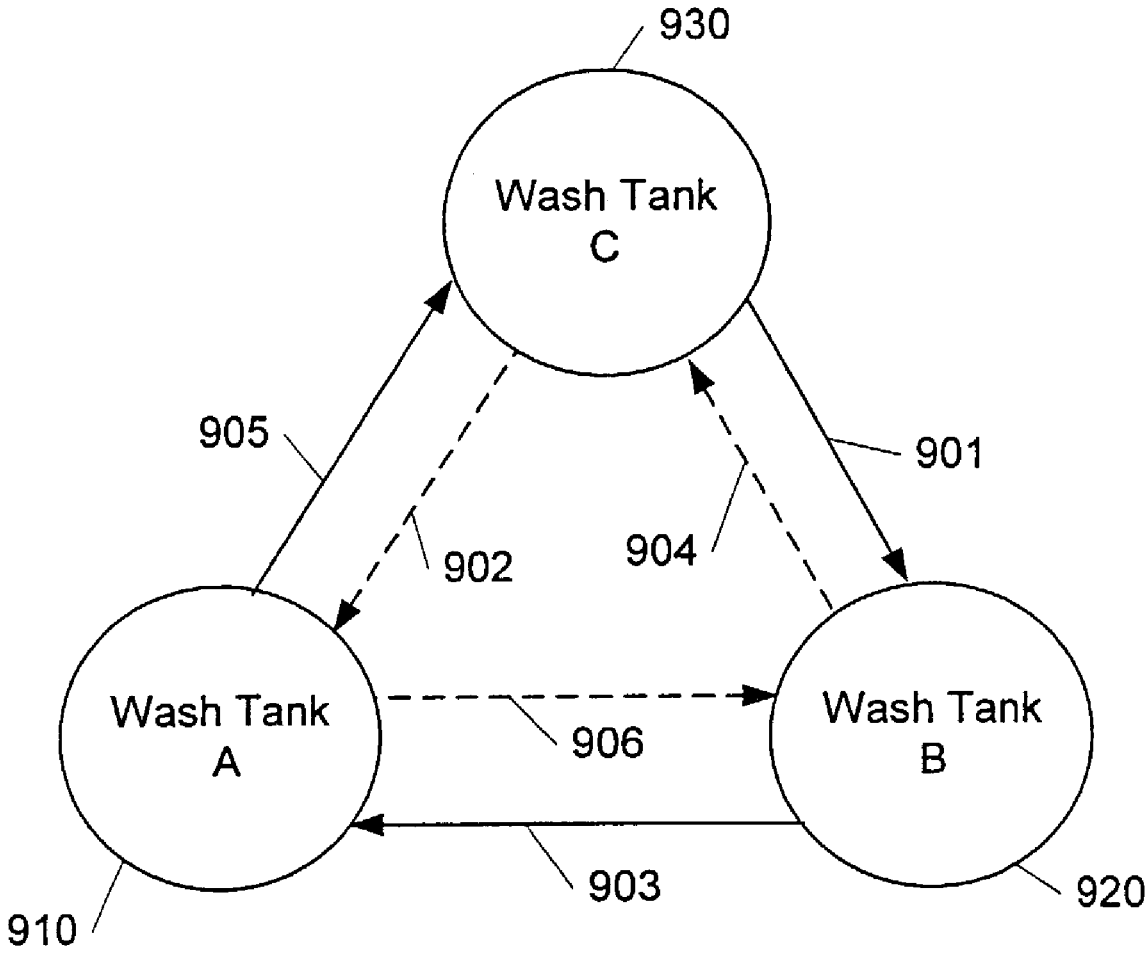
FIG. 9 illustrates the fluid flow in a cleaning apparatus according to the present invention having three wash tanks.

Referring now to FIG. 9, the fluid flow in a cleaning apparatus according to the present invention having three wash tanks will now be described. Wash tank A 910 is in fluid communication with wash tank B 920 and wash tank C 930. Wash tank B 920 is also in fluid communication with wash tank C 930. The initial state of the system is as follows. Clothes are being loaded into wash tank A 910. Wash tank B 920 is storing carbon dioxide vapor and wash tank C 930 is holding liquid cleaning solution, described above with reference to FIG. 1, and clothes that have been washed. Dashed lines indicate vapor fluid flow and solid lines indicate liquid fluid flow.

Liquid cleaning solution is transferred from wash tank C 930 to wash tank B 920 as illustrated by line 901. Carbon dioxide vapor remains in wash tank C 930. Carbon dioxide vapor is then removed from wash tank C 930 and charged into wash tank A 910 as illustrated by line 902. Clothes in wash tank B 920 are washed and then held along with the liquid cleaning solution in wash tank B 920. Vapor is stored in wash tank A 910 and washed clothes are unloaded from and clothes are loaded into wash tank C 930.

Liquid cleaning solution is transferred from wash tank B 920 into wash tank A 910 as illustrated by line 903. Carbon dioxide vapor is then removed from wash tank B 920 and charged into wash tank C 930 as illustrated by line 904. Clothes in wash tank A 910 are washed and then held along with the liquid cleaning solution in wash tank A 910. Vapor is stored in wash tank C 930 and washed clothes are unloaded from and clothes are loaded into wash tank B 920.

The liquid cleaning solution is transferred from wash tank A 910 to wash tank C 930 as illustrated by line 905. Carbon dioxide vapor is then removed from wash tank A 910 and charged into wash tank B 920 as illustrated by line 906. Clothes in wash tank C 930 are washed and then held along with the liquid cleaning solution in wash tank C 930. Vapor is stored in wash tank B 920 and washed clothes are unloaded from and clothes are loaded into wash tank A 910. In addition to the three wash tanks, a cleaning apparatus according to the present invention having three wash tanks may include a working tank, which may be useful for various reasons such as storing cleaning solution when servicing the apparatus or when the apparatus is to be out of service for an extended period of time.

Figure 10:
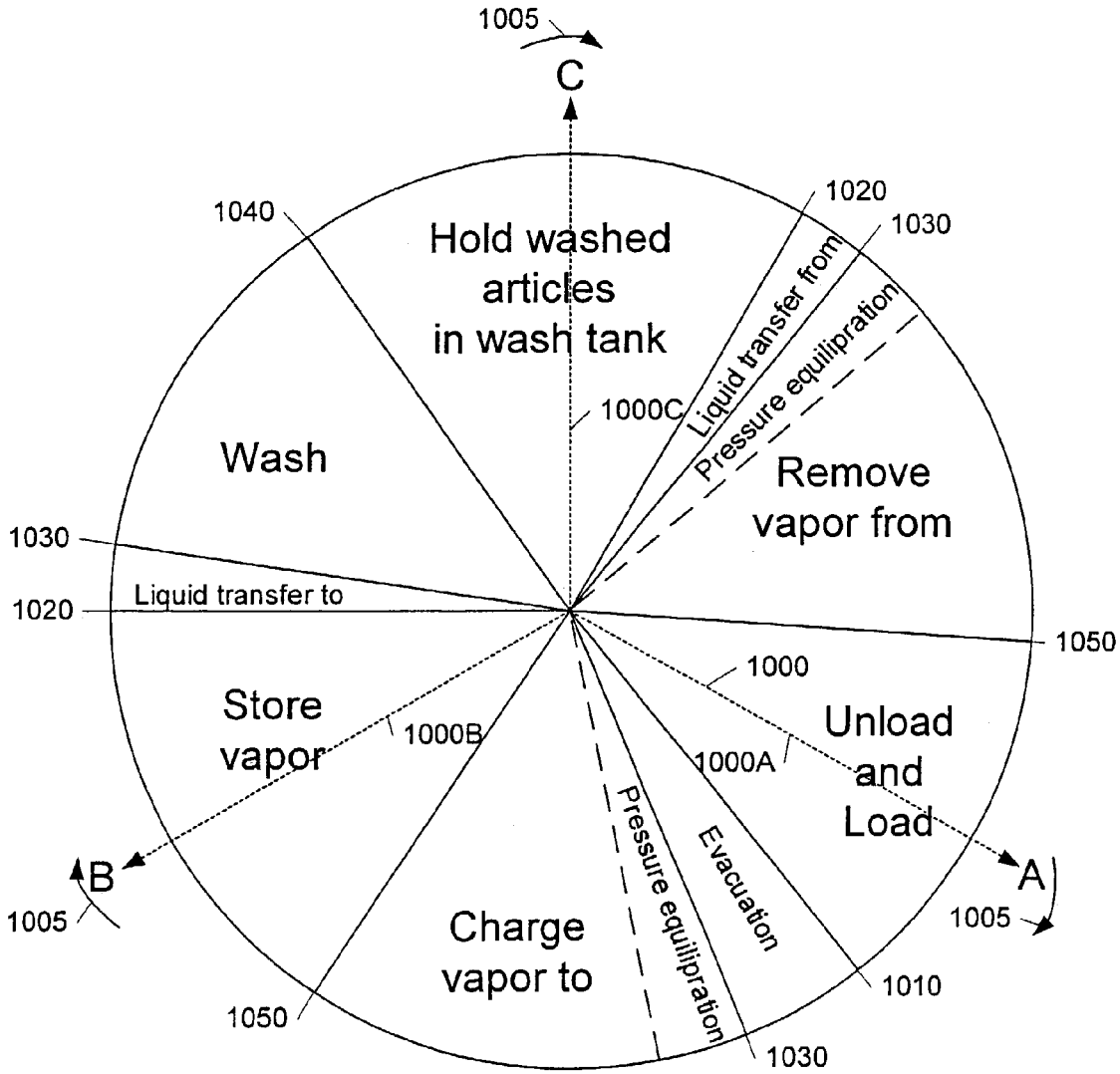
FIG. 10 illustrates a wash cycle for a cleaning apparatus according to the present invention having three wash tanks.

Referring now to FIG. 10, embodiments of a timing relationship between the various operations described above with reference to FIG. 9 will now be described. Process line 1000 represents a given point in time. Process line 1000 has a first segment 1000A, a second segment 1000B, and a third segment 1000C. First segment 1000A of process line 1000 represents the process state of wash tank A at a given point in time, second segment 1000B of process line 1000 represents the process state of wash tank B at a given point in time, and third segment 1000C represents the process state of wash tank C at a given point in time. As a wash cycle progresses, process line 1000 rotates in a clockwise direction as indicated by arrows 1005.

At the initial position of process line 1000 washed clothes are being unloaded from and clothes are being loaded into wash tank A. Carbon dioxide vapor is being stored in wash tank B. Washed clothes and liquid cleaning solution are being held in wash tank C. When process line 1000 reaches time 1010, air is evacuated from wash tank A. While it is preferable that air be evacuated from a wash tank of the present invention prior to charging vapor into the wash tank, it is to be understood that air may be evacuated from some other point in the system, or may not be evacuated at all. When process line 1000 reaches time 1020, liquid is transferred from wash tank C to wash tank B. At time 1030, the evacuation operation and liquid transfer operations are completed. While the embodiments illustrated in FIG. 10 show the evacuation operation occurring concurrently with the liquid transfer operation, it is to be understood that the evacuation operation may occur before the beginning of the liquid transfer operation.

The clothes in wash tank B may be washed while vapor is removed from wash tank C and charged into wash tank A. The removing and charging operations preferably include pressure equilibration between wash tank C and wash tank A. When process line 1000B reaches time 1040, the washing operation is complete. The washed clothes are held in wash tank B while the removing and charging operations are completed and washed clothes are unloaded from and clothes are loaded into wash tank C. Although the embodiments illustrated in FIG. 10 show that clothes are washed immediately after transferring liquid to wash tank A and then held in wash tank A after washing, it is to be understood that clothes may be held in wash tanks of the present invention prior to washing, for example in a prewash (soaking) operation, or may be washed from the time liquid is transferred into the wash tank until the time liquid is transferred out of the wash tank.

At time 1050, the removing and charging operations are complete. Carbon dioxide vapor is stored in wash tank A while washed clothes are unloaded from and clothes are loaded into wash tank C. The aforementioned operations are then repeated for each wash tank as process line 1000 continues to rotate through the wash cycle.

The present invention may be carried out in an any suitable carbon dioxide dry cleaning apparatus, particularly an apparatus as described in U.S. Pat. No. 6,049,931 to McClain et al.; an apparatus as described in J. McClain et al., copending U.S. patent application Ser. No. 09/306,360 (filed May 6, 1999)(disclosing a preferred direct drive system); and an apparatus as disclosed in J. DeYoung et al., copending U.S. patent application Ser. No. 09/312,556 (filed May 14, 1999), the disclosures of all of which are incorporated by reference herein in their entirety.

While the embodiments described above have focused on methods and apparatus for contacting clothes with a liquid carbon dioxide solution, one skilled in the art will appreciate that the methods and apparatus described above could be used for contacting other articles, including but not limited to parts and tools, such as metal substrates and electronic devices.

Although the embodiments described above have focused on cleaning apparatus having multiple wash tanks, it is to be understood that apparatus of the present invention may have one or more coating tanks, which are configured to coat various articles with one or more coating adjuncts in a densified gas solvent, in addition to the one or more wash tanks. In alternative embodiments of the present invention, the apparatus may be a coating apparatus having multiple coating tanks. Coating tanks according to the present invention may be similar to wash tanks described above, and will not be further described herein. For example, coating processes may include coating dry-cleanable articles such as fabric substrates (e.g., garments, linen, drapery, etc.) and other substrates (e.g., leather) as well as coating soft and hard substrates such as metal, wood, paper, fur, feathers, filtration media, electronics, bio-medical devices/tools/implants, tools, stone and construction materials such as concrete and glass, among others. Fabric substrates and leather substrates may be coated with various coating adjuncts such as flame retardants, water repellants, water-resistance agents, water-release agents, sizing agents, sterilizing agents, stain-resistance agents, stain repellants, stain-release agents, anti-bacterial, anti-microbial, anti-viral and other biocide agents, UV resistance agents, and dyes among others. Hard and soft substrates in general may be coated with polymers, as well as many, if not all, of the coatings described for fabric and leather substrates, among other coatings. Electronic substrates may be coated with photoresists, lubricants, insulating layers, conducting layers, polymers, and protecting (e.g., dust resistant) layers, among other coatings.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A method of washing articles using a densified gas dry cleaning system employing a liquid densified gas dry cleaning solution, said method comprising:

removing densified gas vapor from a first wash tank;

charging at least a portion of said densified gas vapor into a second wash tank;

transferring liquid carbon dioxide cleaning solution from a working tank to said second wash tank;

washing a first article in said second wash tank; and transferring liquid carbon dioxide cleaning solution from said second wash tank to said working tank;

wherein said charging of at least a portion of said carbon dioxide vapor into said second wash tank precedes said transferring of liquid carbon dioxide cleaning solution from said working tank to said second wash tank; and wherein the liquid densified gas dry cleaning solution is a carbon dioxide solution and the densified gas vapor is a carbon dioxide vapor.

2. The method according to claim 1, further comprising:

unloading a first washed article from said first wash tank; and loading a second article into said first wash tank;

wherein said removing of carbon dioxide vapor from said first wash tank precedes said unloading of a first washed article from said first wash tank.

3. The method according to claim 2, wherein said unloading of a first washed article from said first wash tank and said loading of a second article into said first wash tank occur during one or more of: transferring liquid carbon dioxide cleaning solution from a working tank to said second wash tank, washing a first article in said second wash tank, and transferring liquid carbon dioxide cleaning solution from said second wash tank to said working tank.

4. The method according to claim 3, wherein said removing of carbon dioxide vapor from a first wash tank and said charging of at least a portion of said carbon dioxide vapor into a second wash tank comprise:

transferring carbon dioxide vapor from said first wash tank having a higher pressure to said second wash tank having a lower pressure utilizing a piping system.

5. The method according to claim 4, wherein said removing of carbon dioxide vapor from a first wash tank and said charging of at least a portion of said carbon dioxide vapor into a second wash tank further comprise:

pumping said carbon dioxide vapor out of said first wash tank using a compressor when the differential pressure between said first wash tank and said second wash tank is less than about 100 psig.

6. The method according to claim 5, wherein said removing of carbon dioxide vapor from a first wash tank and said charging of at least a portion of said carbon dioxide vapor into a second wash tank further comprise:

condensing a portion of said carbon dioxide vapor into liquid carbon dioxide in a condenser; and storing said liquid carbon dioxide in said working tank.

7. The method according to claim 5, wherein said removing of carbon dioxide vapor from a first wash tank and said charging of at least a portion of said carbon dioxide vapor into a second wash tank further comprise:

stopping said compressor when pressure in said first wash tank is less than about 100 psig.

8. The method according to claim 6, wherein said removing of carbon dioxide vapor from a first wash tank further comprises:

venting carbon dioxide vapor from said first wash tank to atmosphere, wherein said stopping of said compressor when pressure in said first wash tank is less than about 100 psig precedes said venting.

9. The method according to claim 2, further comprising:

removing carbon dioxide vapor from said second wash tank; and charging at least a portion of said carbon dioxide vapor removed from said second wash tank into said first wash tank;

wherein said transferring of liquid carbon dioxide cleaning solution from said second wash tank to said working tank precedes said removing of carbon dioxide vapor from said second wash tank.

10. The method according to claim 1, wherein said first article is an article of clothing.

11. A method of washing articles using a densified gas dry cleaning system employing a liquid densified gas dry cleaning solution, said method comprising:

transferring liquid densified gas cleaning solution from a first wash tank to a second wash tank;

removing densified gas vapor from said first wash tank to a vapor tank;

storing said densified gas vapor in said vapor tank; and charging said first wash tank with densified gas vapor from said vapor tank.

12. The method according to claim 11, wherein the densified gas cleaning solution is a carbon dioxide cleaning solution.

13. The method according to claim 11, further comprising:

washing a first article in said second wash tank;

wherein at least a portion of said washing of a first article in said second wash tank occurs during one or more of: removing carbon dioxide vapor from said first wash tank to a vapor tank, storing said carbon dioxide vapor in said vapor tank, and charging said first wash tank with carbon dioxide vapor from said vapor tank.

14. The method according to claim 13, further comprising:

unloading a first washed article from said first wash tank; and loading a second article into said first wash tank;

wherein said unloading of a first washed article from said first wash tank and said loading of a second article into said first wash tank occur during said storing of said carbon dioxide vapor in said vapor tank.

15. The method according to claim 14, further comprising:

transferring liquid carbon dioxide cleaning solution from said second wash tank to said first wash tank;

removing carbon dioxide vapor from said second wash tank to said vapor tank;

storing said carbon dioxide vapor in said vapor tank; and charging said second wash tank with carbon dioxide vapor from said vapor tank;

wherein said charging of said first wash tank with carbon dioxide from said vapor tank precedes said transferring of liquid carbon dioxide cleaning solution from said second wash tank to said first wash tank.

16. The method according to claim 13, wherein said first article is an article of clothing.

17. A method of washing articles using a densified gas dry cleaning system employing a liquid densified gas dry cleaning solution, said method comprising:

transferring liquid densified gas cleaning solution from a first wash tank to a second wash tank;

removing densified gas vapor from said first wash tank; and charging at least a portion of said densified gas vapor into a third wash tank.

18. The method according to claim 17, wherein the densified gas cleaning solution is a carbon dioxide cleaning solution.

19. The method according to claim 18, further comprising:

washing a first article in said second wash tank.

20. The method according to claim 19, further comprising:

transferring liquid carbon dioxide cleaning solution from said second wash tank to said third wash tank;

removing carbon dioxide vapor from said second wash tank; and charging at least a portion of said carbon dioxide vapor removed from said second wash tank into said first wash tank;

wherein said washing of a first article in said second wash tank precedes said transferring of liquid carbon dioxide cleaning solution from said second wash tank to said third wash tank.

21. The method according to claim 20, further comprising:

washing a second article in said third wash tank;

transferring liquid carbon dioxide cleaning solution from said third wash tank to said first wash tank;

removing carbon dioxide vapor from said third wash tank; and charging at least a portion of said carbon dioxide vapor removed from said third wash tank into said second wash tank.

22. The method according to claim 19, wherein said first article is an article of clothing.

23. The method according to claim 1, wherein each of the first and second wash tanks includes an agitation means.

24. The method according to claim 1, wherein each of the first and second wash tanks includes an access means.

25. The method according to claim 11, wherein each of the first and second wash tanks includes an agitation means.

26. The method according to claim 11, wherein each of the first and second wash tanks includes an access means.

27. The method according to claim 17, wherein each of the first and second wash tanks includes an agitation means.

28. The method according to claim 17, wherein each of the first and second wash tanks includes an access means.

* * * * *